US009235146B2

(12) United States Patent
Shimada

(10) Patent No.: US 9,235,146 B2
(45) Date of Patent: Jan. 12, 2016

(54) PHOTOCONDUCTOR

(71) Applicant: Tomoyuki Shimada, Shizuoka (JP)
(72) Inventor: Tomoyuki Shimada, Shizuoka (JP)
(73) Assignee: RICOH COMPANY, LTD., Tokyo (JP)

( * ) Notice: Subject to any disclaimer, the term of this patent is extended or adjusted under 35 U.S.C. 154(b) by 0 days.
(21) Appl. No.: 14/468,603
(22) Filed: Aug. 26, 2014
(65) Prior Publication Data
US 2015/0079509 A1 Mar. 19, 2015
(30) Foreign Application Priority Data
Sep. 13, 2013 (JP) ..... 2013-190393
(51) Int. Cl.
*G03G 5/047* (2006.01)
*G03G 5/06* (2006.01)
(52) U.S. Cl.
CPC ..... *G03G 5/0662* (2013.01); *G03G 5/0696* (2013.01)
(58) Field of Classification Search
CPC ..... G03G 5/0662
See application file for complete search history.

(56) References Cited

U.S. PATENT DOCUMENTS

| | | | | |
|---|---|---|---|---|
| 6,313,288 | B1 | 11/2001 | Shimada et al. | |
| 2002/0007056 | A1 | 1/2002 | Shimada et al. | |
| 2008/0268358 | A1 * | 10/2008 | Lin | G03G 5/0614 430/69 |

FOREIGN PATENT DOCUMENTS

| | | |
|---|---|---|
| JP | 05-2073776 | 10/1993 |
| JP | 2000-212462 | 8/2000 |
| JP | 2004-352916 | 12/2004 |
| JP | 3765324 | 2/2006 |

OTHER PUBLICATIONS

Y. Fujimaki, at al., High Photosensitivity of an Organic Photoreceptor, Proc. IS & T's 7th, pp. 269-275 (1991).
(Continued)

*Primary Examiner* — Peter Vajda
(74) *Attorney, Agent, or Firm* — Cooper & Dunham LLP

(57) ABSTRACT

A photoconductor, which contains an electrically conductive support, and at least a photoconductive layer provided over the electrically conductive support, wherein the photoconductive layer contains a compound represented by the following general formula (1):

General Formula (1)

where $R^1$, $R^2$, $R^3$, $R^4$, $R^5$ and $R^6$ are each independently a hydrogen atom, a halogen atom, an alkyl group, an aralkyl group, an alkoxy group, or an aralkyloxy group; n, a, b, c, and d are each independently an integer of 1 to 4 and m is 1 or 2; and a plurality of $R^1$, $R^2$, $R^3$, $R^4$, $R^5$ or $R^6$ may be the same or different when n, m, a, b, c, or d is an integer of 2 or greater.

9 Claims, 17 Drawing Sheets

(56) References Cited

OTHER PUBLICATIONS

K. Watanabe, et al., Syntheses and Properties of Titanyl Phthalocyanine New Polymorphs, Proc. IS & T's 9th, pp. 659-662 (1993).

Yu Chen, et al., Synthesis of the Axially Substituted Titanium Pc-$C_{60}$ Dyad with a Convenient Method, Organic Letters, vol. 7, No. 8, pp. 1613-1616 (2005).

* cited by examiner

PHOTOCONDUCTOR

BACKGROUND OF THE INVENTION

1. Field of the Invention

The present invention relates to a photoconductor, an image forming apparatus, a process cartridge, a compound, and a composition.

2. Description of the Related Art

As for a photoconductor for use in an electrophotographic system, an organic photoconductor has been conventionally known. The electrophotographic system is an image forming process, which is a so-called Carlson process.

There have recently been significant developments with image processing system devices using an electrophotographic system. Especially a digital recording system, where information is recorded with light by converting information into digital signals, has been applied not only printers, but also photocopiers. So-called digital photocopiers have been developed.

As for a light source for use in a digital recording system, a semiconductor laser (LD) or a light-emitting diode (LED) is often used. The emission wavelength range of the LD is in the near infrared region, and the emission wavelength of the LED is longer than 650 nm. Therefore, desired is a photoconductor having high sensitivity in the near infrared region.

In Japanese Patent Application Laid-Open (JP-A) No. 2004-352916, disclosed is a method for producing a pigment containing a butanediol adduct of titanyl phthalocyanine, by allowing 0.6 mol to 1.0 mol of (2R,3R)-2,3-butanediol and/or (2S,3S)-2,3-butanediol to react with 1 mol of titanyl phthalocyanine, followed by treating the reaction product in a solvent in the presence of water. In the X-ray powder diffraction spectrum with the Bragg angle 2θ (±0.2°, the butanediol adduct of titanyl phthalocyanine has a distinct peak at 8.3°.

SUMMARY OF THE INVENTION

A conventional photoconductor has problems that sensitivity is low in the near infrared region, and reductions in charging ability and sensitivity occur due to fatigue from repeated use.

Considering the aforementioned problems in the art, an aspect of the present invention aims to provide a photoconductor, which has excellent sensitivity in the near infrared region, and can prevent reductions in charging ability and sensitivity due to fatigue from repeated use.

In one aspect of the present invention, a photoconductor contains an electrically conductive support, and at least a photoconductive layer provided over the electrically conductive support, wherein the photoconductive layer contains a compound represented by the following general formula (1):

General Formula (1)

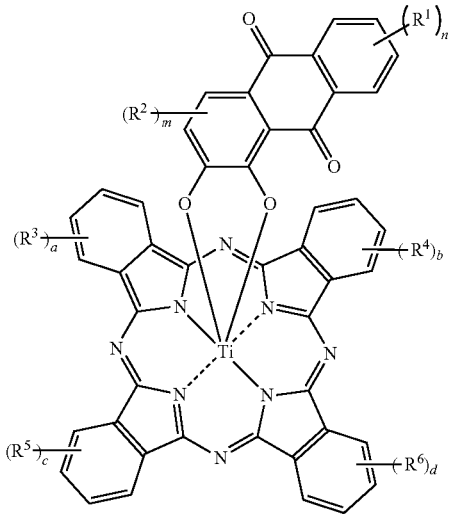

where $R^1$, $R^2$, $R^3$, $R^4$, $R^5$ and $R^6$ are each independently a hydrogen atom, a halogen atom, an alkyl group, an aralkyl group, an alkoxy group, or an aralkyloxy group; n, a, b, c, and d are each independently an integer of 1 to 4 and m is 1 or 2; and a plurality of $R^1$, $R^2$, $R^3$, $R^4$, $R^5$ or $R^6$ may be the same or different when n, m, a, b, c, or d is an integer of 2 or greater.

In another aspect of the present invention, a compound is a compound represented by the general formula (1).

The one aspect of the present invention can provide a photoconductor, which has excellent sensitivity in the near infrared region, and can prevent reductions in charging ability and sensitivity due to fatigue from repeated use.

DETAILED DESCRIPTION OF THE INVENTION

Next, embodiments for carrying out the present invention are explained.

(Photoconductor)

Figure 1:
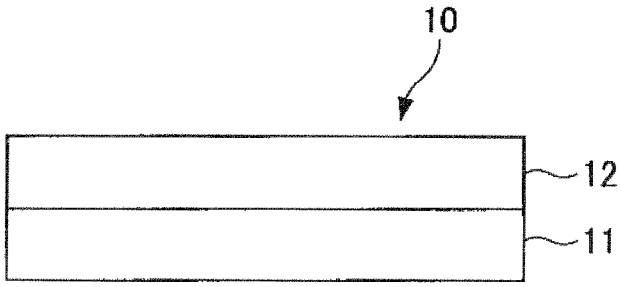
FIG. 1 is a diagram illustrating an example of a layer structure of a photoconductor.

FIG. 1 illustrates one example of a layer structure of a photoconductor.

In a photoconductor 10, a photoconductive layer 12 having a single layer structure is formed on an electrically conductive support 11. The photoconductive layer 12 contains a compound represented by the general formula (1), a charge transport material, and a binder resin. Therefore, a sensitivity of the photoconductor 10 in the near infrared region can be improved.

In addition to the compound represented by the general formula (1), the photoconductive layer 12 preferably further contains a compound represented by the general formula (2).

General Formula (2)

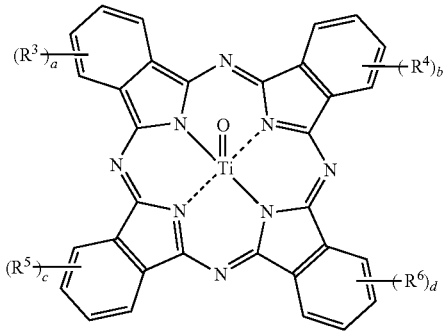

In the formula above, $R^3$, $R^4$, $R^5$, $R^6$, a, b, c, and d are the same as in the general formula (1).

Moreover, the photoconductive layer 12 more preferably contains a reaction product between the compound represented by the general formula (2), and a compound represented by the general formula (3).

General Formula (3)

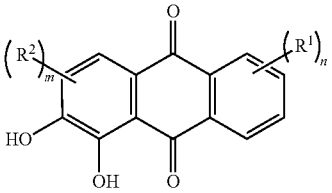

In the formula above, $R^1$, $R^2$, m, and n are the same as in the general formula (1).

Use of the aforementioned compound in combination with the compound represented by the general formula (1) can prevent reduction in charging ability and sensitivity due to fatigue from repeated use, as well as further improving a sensitivity of the photoconductor 10 in the near infrared region.

The halogen atom of $R^1$, $R^2$, $R^3$, $R^4$, $R^5$, and $R^6$ is not particularly limited, and examples thereof include a fluorine atom, a chlorine atom, a bromine atom, and an iodine atom.

The alkyl group of $R^1$, $R^2$, $R^3$, $R^4$, $R^5$ and $R^6$ is not particularly limited, and examples thereof include: a C1-C20 straight-chain, or branched-chain alkyl group, such as a methyl group, an ethyl group, an n-propyl group, an isopropyl group, an n-butyl group, an isobutyl group, a sec-butyl group, a tert-butyl group, an n-pentyl group, an isopentyl group, a tert-pentyl group, an n-hexyl group, an n-octyl group, an isooctyl group, a dodecyl group, and a cetyl group; and a C5-C7 cycloalkyl group, such as a cyclohexyl group and a cyclohexyl methyl group.

The aralkyl group of $R^1$, $R^2$, $R^3$, $R^4$, $R^5$, and $R^6$ is not particularly limited, and examples thereof include a benzyl group.

The alkoxy group of $R^1$, $R^2$, $R^3$, $R^4$, $R^5$, and $R^6$ is not particularly limited, and examples thereof include: a C1-C20 straight-chain or branched-chain alkyloxy group, such as a methoxy group, an ethoxy group, an n-propoxy group, an isopropoxy group, an n-butoxy group, an isobutoxy group, a sec-butoxy group, a tert-butoxy group, an n-pentyloxy group, an isopentyloxy group, a tert-pentyloxy group, an n-hexyloxy group, an n-octyloxy group, an isooctyloxy group, a dodecyloxy group, and a cetyloxy group; and a C5-C7 cycloalkyloxy group, such as a cyclohexyloxy group and a cyclohexylmethyloxy group.

The aralkyloxy group of $R^1$, $R^2$, $R^3$, $R^4$, $R^5$, and $R^6$ is not particularly limited, and examples thereof include a benzyloxy group.

Note that, the compound represented by the general formula (1) can be synthesized through a reaction between the compound represented by the general formula (2) and the compound represented by the general formula (3).

Compounds represented by the general formulae (1), (2), and (3), where $R^1$, $R^2$, $R^3$, $R^4$, $R^5$, and $R^6$ are all hydrogen atoms are explained hereinafter. Note that, as for compounds represented by the general formulae (1), (2), and (3), where $R^1$, $R^2$, $R^3$, $R^4$, $R^5$, and $R^6$ are groups other than a hydrogen atom, the groups other than a hydrogen atom can be introduced by a method known in the art.

The titanyl phthalocyanine represented by the following chemical formula can be synthesized through a reaction between phthalonitrile and titanium tetrachloride.

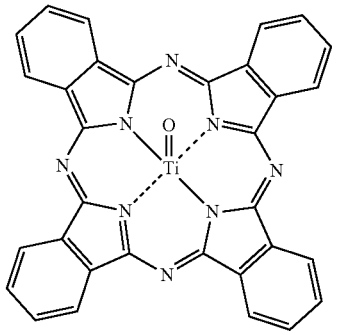

Note that, the titanyl phthalocyanine may be synthesized through a reaction between diiminoisoindoline and alkoxy titanium, or synthesized through a reaction between phthalonitrile, urea, and alkoxy titanium (see, for example, Bull. Chem. Soc. Japan., 68, 1001-1005 (1995)).

The alkoxy titanium is represented by the general formula (4).

$Ti(OR)_4$ General Formula (4)

In the formula above, R is an alkyl group.

The alkyl group of R in the general formula (4) is not particularly limited, and examples thereof include a methyl group, an ethyl group, an n-propyl group, an isopropyl group, an n-butyl group, an isobutyl group, a sec-butyl group, a tert-butyl group, and an octadecanyl group. Among them, an n-butyl group is preferable.

When the titanyl phthalocyanine is synthesized, a solvent may be used.

The solvent is not particularly limited, and examples thereof include α-chloronaphthalene, dichlorobenzene, trichlorobenzene, pentanol, 1-octanol, 2-octanol, benzyl alcohol, N,N-dimethylformamide, N-methylpyrrolidone, quinoline, benzene, toluene, xylene, mesitylene, nitrobenzene, and dioxane.

When the titanyl phthalocyanine is synthesized, urea, formamide, acetoamide, benzamide, 1,8-diazabicyclo[5,4,0]-7-undecene (DBU), or ammonium may be optionally added.

The temperature for synthesizing the titanyl phthalocyanine is typically room temperature to 300° C., preferably 140° C. to 260° C.

The titanyl phthalocyanine obtained using titanium tetrachloride includes a trace (0.2% to 0.6% of chlorine as an elementary analysis value) of chlorinated titanyl phthalocyanine as impurities.

The titanyl phthalocyanine may be of A-type (β-type), B-type (α-type), or Y-type, but the titanyl phthalocyanine is preferably an α-type titanyl phthalocyanine having a low crystallization degree, which is made amorphous by an acid paste treatment.

The acid paste treatment is a treatment, in which after dissolving a pigment in an acid at the temperature of −5° C. to room temperature, the resulting solution is added dropwise to ice, water iced water, or a mixed solvent of water and water-soluble organic solvent to precipitate crystals of the pigment, to obtain a pigment through filtration.

The acid is not particularly limited, and exampled thereof include sulfuric acid, hydrochloric acid, phosphoric acid, methanesulfonic acid, trichloroacetic acid, and trifluoroacetic acid. Among them, strong sulfuric acid is preferably because it has high solubility of titanyl phthalocyanine, does not have smoke emission, and is easily handled.

The titanyl phthalocyanine, which has been subjected to the acid paste treatment, is preferably washed with water, or a mixed solvent of a water-soluble organic solvent and water to remove impurities generated by hydrolysis, optionally followed by neutralizing the acid with a basic aqueous solution.

The water-soluble organic solvent is not particularly limited, and examples thereof include: lower alcohol, such as methanol, and ethanol; lower ketone, such as acetone, and methyl ethyl ketone; ether, such as diethyl ether, methyl cellosolve, and dioxane; dimethylformamide; and dimethyl sulfoxide.

The base for the basic aqueous solution is not particularly limited, and examples thereof include: hydroxide of alkali metal, such as sodium hydroxide, and potassium hydroxide; carbonic acid salt of alkali metal, such as sodium carbonate, and potassium carbonate; hydroxide of alkali earth metal, such as magnesium hydroxide; and hydroxide of ammonia, or quaternary ammonium.

The molar equivalent ratio of the base to the acid is typically 0.5 to 1.5, preferably 0.8 to 1.2.

The alizarin adduct of titanium phthalocyanine represented by the following chemical formula can be synthesized by allowing titanyl phthalocyanine to react with the alizarin represented by the following chemical formula.

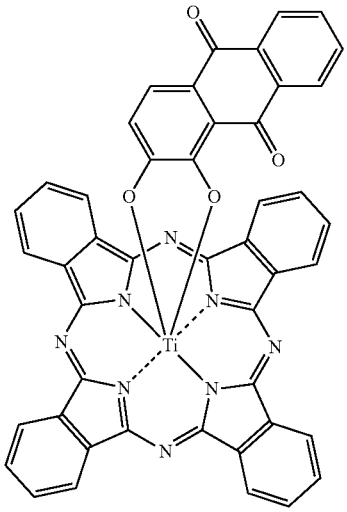

-continued

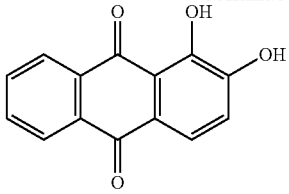

When the alizarin adduct of titanium phthalocyanine is synthesized, a solvent may be used.

The solvent is not particularly limited, and examples thereof include tetrahydrofuran, dioxolane, diglyme, methyl ethyl ketone, methyl isobutyl ketone, cyclohexanone, acetophenone, α-chloronaphthalene, dichlorobenzene, trichlorobenzene, pentanol, octanol, benzyl alcohol, N,N-dimethylformamide, N-methylpyrrolidone, quinoline, benzene, toluene, xylene, mesitylene, nitrobenzene, and dioxane.

The temperature for synthesizing the alizarin adduct of titanium phthalocyanine is typically room temperature to 300° C., preferably 50° C. to 210° C.

When the alizarin adduct of titanium phthalocyanine is synthesized, a molar ratio of the alizarin to the titanyl phthalocyanine is typically 1 or greater.

When the molar ratio of the alizarin to the titanyl phthalocyanine is less than 1, a mixture of an alizarin adduct of titanium phthalocyanine and titanyl phthalocyanine is obtained.

In this case, a molar ratio of the alizarin to the titanyl phthalocyanine is typically 1/999 or greater, preferably 1/99 to 0.5. When the molar ratio of the alizarin to the titanyl phthalocyanine is less than 1/999, the sensitivity of the photoconductor 10 in the near infrared region may be low.

Crystals of the alizarin adduct of titanium phthalocyanine, or the mixture of the alizarin adduct of titanium phthalocyanine and the titanyl phthalocyanine can be converted by treating with a solvent. As a result, the sensitivity of the resulting photoconductor 10 in the near infrared region is further improved, and also reductions in charging ability and sensitivity thereof due to fatigue from repeated use can be prevented further.

The method for treating with the solvent is not particularly limited, and examples thereof include: a method where the adduct or mixture is pulverized in a solvent; a method where the adduct or mixture is immersed in a solvent; and a method where the adduct or mixture is suspended and stirred in a solvent.

The solvent is not particularly limited, and examples thereof include benzene, toluene, chlorobenzene, dichlorobenzene, nitrobenzene, methanol, ethanol, benzyl alcohol, acetone, cyclohexanone, methyl ethyl ketone, n-butyl ether, ethylene glycol, tetrahydrofuran, N,N-dimethylformamide, N-methylpyrrolidone, quinoline, pyridine, dimethyl sulfoxide, and water. These may be used in combination.

A mass ratio of the solvent to the alizarin adduct of titanium phthalocyanine or the mixture of the alizarin adduct of titanium phthalocyanine and titanyl phthalocyanine is typically 1 to 200, preferably 10 to 100.

The temperature for treating with the solvent is typically 0° C. to 150° C., preferably room temperature to 100° C.

When pulverized in the solvent, a ball mill, a mortar, a sand mill, a kneader, or Attritor may be used.

When pulverized in the solvent, moreover, an inorganic compound, such as decahydrate (mirabilite) of sodium chloride, or sodium sulfate, or grinding media, such as glass beads, steel beads, and alumina beads, may be used.

The average particle diameter of the alizarin adduct of titanium phthalocyanine, or the mixture of the alizarin adduct of titanium phthalocyanine and the titanyl phthalocyanine is typically 2 μm or smaller, preferably 1 μm or smaller. When the average particle diameter thereof is in the aforementioned range, dispersibility of the alizarin adduct of titanium phthalocyanine, or the mixture of the alizarin adduct of titanium phthalocyanine and the titanyl phthalocyanine in the photoconductive layer 12 can be improved. Note that, the average particle diameter of the alizarin adduct of titanium phthalocyanine, or the mixture of the alizarin adduct of titanium phthalocyanine and the titanyl phthalocyanine is typically 0.01 μm or greater.

The photoconductive layer 12 may further contain an azo pigment or a phthalocyanine pigment.

The azo pigment is not particularly limited, and examples thereof include C.I. Pigment Blue 25 (Color Index [CI] 21180), C.I. Pigment Red 41 (CI-21200), C.I. Acid Red 52 (CI-45100), C.I. Basic Red 3 (CI-45210), an azo pigment having a carbazole skeleton (see, for example, JP-A No. 53-95033), an azo pigment having a distyrylbenzene skeleton (see, for example, JP-A No. 53-133445), an azo pigment having a triphenylamine skeleton (see, for example, JP-A No. 53-132347), an azo pigment having a dibenzothiophene skeleton (see, for example, JP-A No. 54-21728), an azo pigment having an oxadiazole skeleton (see, for example, JP-A No. 54-12742), an azo pigment having a fluorenone skeleton (see, for example, JP-A No. 54-22834), an azo pigment having a bisstilbene skeleton (see, for example, JP-A No. 54-17733), an azo pigment having a distyryloxadiazole skeleton (see, for example, JP-A No. 54-2129), and an azo pigment having a distyrylcarbazole skeleton (see, for example, JP-A No. 54-14967).

The phthalocyanine pigment is not particularly limited, and examples thereof include copper phthalocyanine, nonmetal phthalocyanine, aluminum phthalocyanine, magnesium phthalocyanine, chlorogallium phthalocyanine, hydroxygallium phthalocyanine, vanadyl phthalocyanine, titanyl phthalocyanine, chloroindium phthalocyanine, hydroxyindium phthalocyanine, zinc phthalocyanine, iron phthalocyanine, and cobalt phthalocyanine.

The binder resin is not particularly limited, and examples thereof include polyethylene, polyvinyl butyral, polyvinyl formal, polystyrene, a phenoxy resin, polypropylene, an acrylic resin, a methacrylic resin, a vinyl chloride resin, a vinyl acetate resin, an epoxy resin, polyurethane, a phenol resin, polyester, an alkyd resin, polycarbonate, polyamide, a silicone resin, melamine resin, a vinyl chloride-vinyl acetate copolymer, a styrene-acryl copolymer, and a vinyl chloride-vinyl acetate-maleic anhydride copolymer. These may be used in combination.

A mass ratio of the compounds represented by the general formulae (1) and (2) to the binder resin is typically 0.05 to 0.95.

The charge transport material may be a low molecular charge transport material (a low molecular hole transport material and a low molecular electron transport material), or a high molecular charge transport material. These may be used in combination. Note that, the high molecular charge transport material may also function as a binder resin.

The low molecular hole transport material is not particularly limited, and examples thereof include an oxazole derivative, an imidazole derivative, a triphenylamine derivative, and compounds represented by the general formulae (5) to (22).

General Formula (5)

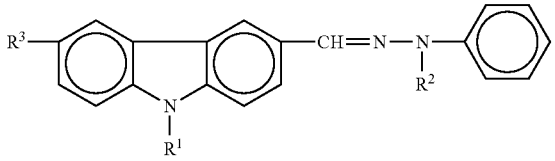

In the formula above, $R^1$ is a methyl group, an ethyl group, a 2-hydroxyethyl group, or a 2-chloroethyl group; $R^2$ is a methyl group, an ethyl group, a benzyl group, or a phenyl group; and $R^3$ is a hydrogen atom, a chlorine atom, a bromine atom, a C1-C4 alkyl group, a C1-C4 alkoxy group, a dialkylamino group, or a nitro group.

General Formula (6)

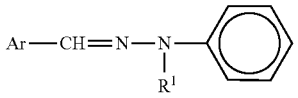

In the formula above, Ar is a substituted or unsubstituted monovalent aromatic group derived from naphthalene, anthracene, pyrene, pyridine, furan, or thiophene; and R is an alkyl group, a phenyl group, or a benzyl group.

General Formula (7)

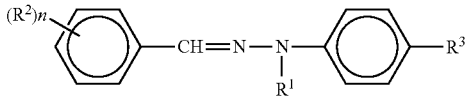

In the formula above, $R^1$ is an alkyl group, a benzyl group, a phenyl group, or a naphthyl group; $R^2$ is a hydrogen atom, a C1-C3 alkyl group, a C1-C3 alkoxy group, a dialkylamino group, a diaralkylamino group, or a diaryl amino group; $R^3$ is a hydrogen atom or a methoxy group; and n is an integer of 1 to 4, and a plurality of $R^2$ may be the same or different, when n is 2 or greater.

General Formula (8)

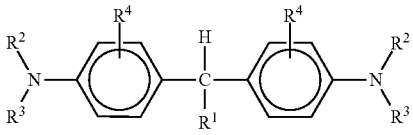

In the formula above, $R^1$ is a C1-C11 alkyl group, a substituted or unsubstituted phenyl group, or a monovalent heterocyclic group; $R^2$ and $R^3$ are each independently a hydrogen atom, a C1-C4 alkyl group, a hydroxyalkyl group, a chloroalkyl group, or a substituted or unsubstituted aralkyl group, where $R^2$ and $R^3$ may bond to each other to form a heterocyclic ring containing a nitrogen atom; and $R^4$ is a hydrogen atom, a C1-C4 alkyl group, an alkoxy group, or a halogen atom.

General Formula (9)

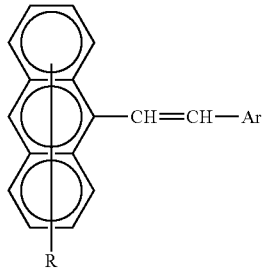

In the formula above, R is a hydrogen atom, or a halogen atom; and Ar is a substituted or unsubstituted phenyl group, a naphthyl group, an anthryl group, or a carbazolyl group.

General Formula (10)

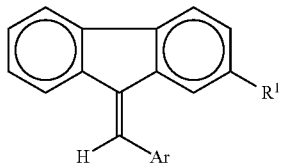

In the formula above, $R^1$ is a hydrogen atom, a halogen atom, a cyano group, a C1-C4 alkoxy group, or a C1-C4 alkyl group; and Ar is any of groups represented by the general formulae.

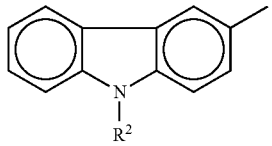

In the formula above, $R^2$ is a C1-C4 an alkyl group.

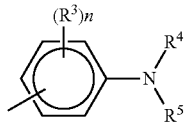

In the formula above, $R^3$ is a hydrogen atom, a halogen atom, a C1-C4 alkyl group, a C1-C4 alkoxy group, or a dialkylamino group; $R^4$ and $R^5$ are each independently a hydrogen atom, a substituted or unsubstituted C1-C4 alkyl group, or a substituted or unsubstituted benzyl group; n is 1 or 2; and a plurality of $R^3$ may be the same or different when n is 2.

General Formula (11)

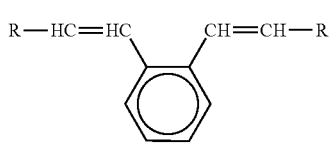

In the formula above, R is a carbazolyl group, a pyridyl group, a thienyl group, an indolyl group, or a furyl group, or a substituted or unsubstituted phenyl group, styryl group, naphthyl group, or anthryl group, where the substituent is a dialkyl amino group, an alkyl group, an alkoxy group, a carboxyl group, an alkyloxycarbonyl group, a halogen atom, a cyano group, an aralkylamino group, a N-alkyl-N-aralkylamino group, an amino group, a nitro group, or an acetylamino group.

General Formula (12)

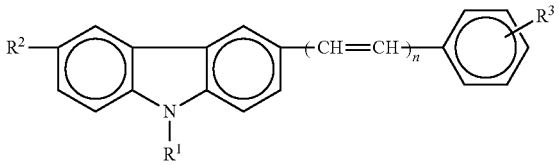

In the formula above, $R^1$ is an alkyl group, a substituted or unsubstituted phenyl group, or a benzyl group; $R^2$ and $R^3$ are each independently a hydrogen atom, an alkyl group, an alkoxy group, a halogen atom, a nitro group, an amino group, an alkylamino group, or a benzylamino group; and n is 1 or 2.

General Formula (13)

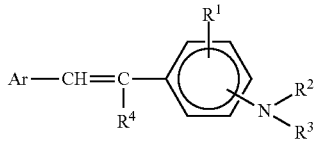

In the formula above, $R^1$ is a hydrogen atom, an alkyl group, an alkoxy group, or a halogen atom; $R^2$ and $R^3$ are each independently a substituted or unsubstituted aryl group; $R^4$ is a hydrogen atom, an alkyl group, or a substituted or unsubstituted phenyl group; and Ar is a substituted or unsubstituted phenyl group, or a naphthyl group.

General Formula (14)

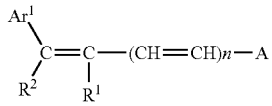

In the formula above, $R^1$ is a hydrogen atom, an alkyl group, or a substituted or unsubstituted phenyl group; $Ar^1$ is a substituted or unsubstituted aryl group; $R^2$ is substituted or unsubstituted alkyl group, or a substituted or unsubstituted aryl group; A is any of groups represented by the following general formulae, or 9-anthryl group, or a substituted or unsubstituted carbazolyl group; and n is 0 or 1, and A and $R^1$ may bond to each other to form a ring, when n is 0.

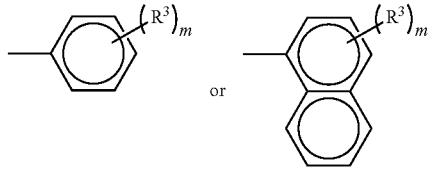

In the formulae above, $R^3$ is a hydrogen atom, an alkyl group, an alkoxy group, a halogen atom, or a group represented by the general formula below:

$—NR^4R^5$ where $R^4$ and $R^5$ are each independently a substituted or unsubstituted aryl group, and $R^4$ and $R^5$ may bond to each other to form a heterocycle containing a nitrogen atom; and a plurality of $R^3$ may be the same or different, when m is 2 or greater.

General Formula (15)

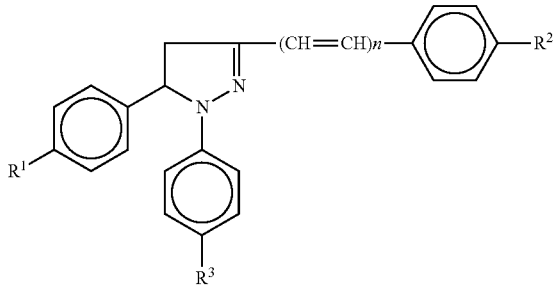

In the formula above, $R^1$, $R^2$, and $R^3$ are each independently a hydrogen atom, an alkyl group, an alkoxy group, a halogen atom, or a dialkyl amino group; and n is 0 or 1.

General Formula (16)

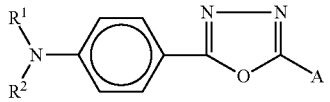

In the formula above, $R^1$ and $R^2$ are each a substituted or unsubstituted alkyl group, or a substituted or unsubstituted aryl group; and A is an amino group substituted with a substituent, a substituted or unsubstituted aryl group, or an allyl group.

General Formula (17)

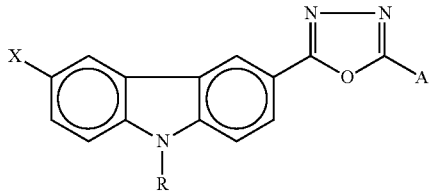

In the formula above, X is a hydrogen atom, an alkyl group, or a halogen atom; R is a substituted or unsubstituted alkyl group, or a substituted or unsubstituted aryl group; and A is an amino group substituted with a substituent, or a substituted or unsubstituted aryl group.

General Formula (18)

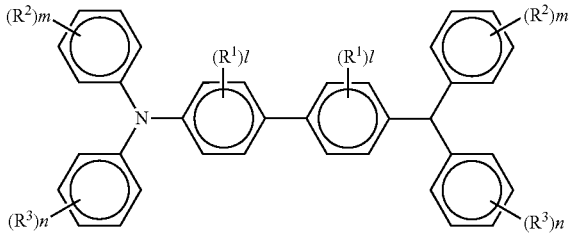

In the formula above, $R^1$ is an alkyl group, an alkoxy group, or a halogen atom; $R^2$ and $R^3$ are each independently a hydrogen atom, an alkyl group, an alkoxy group, or a halogen atom; l, m, and n are each independently an integer of 0 to 4, and a plurality of $R^1$, $R^2$, or $R^3$ may be the same or different, when l, m, or n is 2 or greater.

General Formula (19)

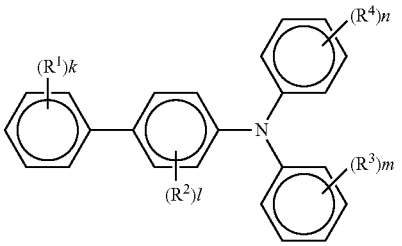

In the formula above, $R^1$, $R^3$, and $R^4$ are each a hydrogen atom, an amino group, an alkoxy group, a thioalkoxy group, an aryloxy group, a methylene dioxy group, a substituted or unsubstituted alkyl group, a halogen atom, or a substituted or unsubstituted aryl group; $R^2$ is a hydrogen atom, an alkoxy group, a substituted or unsubstituted alkyl group, or a halogen atom; and k, l, m, and n are each independently an integer of 1 to 4, and a plurality of $R^1$, $R^2$, $R^3$, or $R^4$ may be the same or different, when k, l, m, or n is 2 or greater, excluding the case where $R^1$, $R^2$, $R^3$, and $R^4$ are each a hydrogen atom.

General Formula (20)

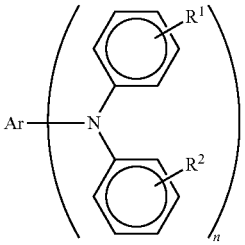

In the formula above, Ar is a substituted or unsubstituted condensed polycyclic hydrocarbon group the number of carbon atoms of which is 18 or less; $R^1$ and $R^2$ are each independently a hydrogen atom, a halogen atom, a substituted or unsubstituted alkyl group, an alkoxy group, or a substituted or unsubstituted phenyl group; and n is 1 or 2.

A-CH═C-Ar-CH═CH-A General Formula (21)

In the formula above, Ar is a substituted or unsubstituted aromatic hydrocarbon group; and A is a group represented by the following general formula:

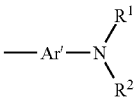

where $Ar^1$ is a substituted or unsubstituted aromatic hydrocarbon group; and $R^1$ and $R^2$ are each independently a substituted or unsubstituted alkyl group, or a substituted or unsubstituted aryl group.

General Formula (22)

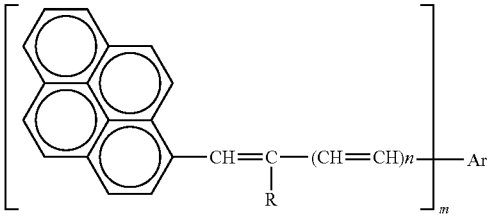

In the formula above, Ar is a substituted or unsubstituted aromatic hydrocarbon group; R is a hydrogen atom, a substituted or unsubstituted an alkyl group, or a substituted or unsubstituted aryl group; n is 0 or 1; m is 1 or 2; and Ar and R may bond to each other to form a ring, when n is 0 and m is 1.

Examples of the compound represented by the general formula (5) include 9-ethylcarbazole-3-carboaldehyde-1-methyl-1-phenylhydrazone, 9-ethylcarbazole-3-carboaldehyde-1-benzyl-1-phenylhydrazone, and 9-ethylcarbazole-3-carboaldehyde-1,1-diphenylhydrazone.

Examples of the compound represented by the general formula (6) include 4-diethylaminostyryl-6-carboaldehyde-1-methyl-1-phenylhydrazone, and 4-methoxynaphthalene-1-carboaldehyde-1-benzyl-1-phenylhydrazone. Examples of the compound represented by the general formula (7) include 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxyphenyl)hydrazone, 4-diphenylaminobenzaldehyde-1-benzyl-1-phenylhydrazone, and 4-dibenzylaminobenzaldehyde-1,1-diphenylhydrazone.

Examples of the compound represented by the general formula (8) include 1,1-bis(4-dibenzylaminophenyl)propane, tris(4-diethylaminophenyl)methane, 1,1-bis(4-dibenzylaminophenyl)propane, and 2,2'-dimethyl-4,4'-bis(diethylamino)triphenylmethane.

Examples of the compound represented by the general formula (9) include 9-(4-diethylaminostyryl)anthracene, and 9-bromo-10-(4-diethylaminostyryl)anthracene.

Examples of the compound represented by the general formula (10) include 9-(4-dimethylaminobenzylidene)fluorene, and 3-(9-fluorenylidene)-9-ethylcarbazole.

Examples of the compound represented by the general formula (11) include 1,2-bis(4-diethylaminostyryl)benzene, and 1,2-bis(2,4-dimethoxystyryl)benzene.

Examples of the compound represented by the general formula (12) include 3-styryl-9-ethylcarbazole, and 3-(4-methoxystyryl)-9-ethylcarbazole.

Examples of the compound represented by the general formula (13) include 4-diphenylaminostilbene, 4-dibenzylaminostilbene, 4-ditolylaminostilbene, 1-(4-diphenylaminostyryl)naphthalene, and 1-(4-diphenylaminostyryl)naphthalene.

Examples of the compound represented by the general formula (14) include 4'-diphenylamino-α-phenylstilbene, and 4'-bis(4-methylphenyl)amino-α-phenylstilbene.

Examples of the compound represented by the general formula (15) include 1-phenyl-3-(4-diethylaminostyryl)-5-(4-diethylaminophenyl)pyrazoline.

Examples of the compound represented by the general formula (16) include 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

Examples of the compound represented by the general formula (17) include 2-N, N-diphenylamino-5-(N-ethylcarbazol-3-yl)-1,3,4-oxadiazole, and 2-(4-diethylaminophenyl)-5-(N-ethylcarbazol-3-yl)-1,3,4-oxadiazole.

Examples of the compound represented by the general formula (18) include N,N'-diphenyl-N,N'-bis(3-methylphenyl)-[1,1'-biphenyl]-4,4'-diamine, and 3,3'-dimethyl-N,N,N',N'-tetrakis(4-methylphenyl)-[1,1'-biphenyl]-4,4'-diamine.

Examples of the compound represented by the general formula (19) include 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, and N,N-bis(3,4-dimethylphenyl)-[1,1'-biphenyl]-4-amine.

Examples of the compound represented by the general formula (20) include N,N-diphenylpyrene-1-amine, N,N-di-p-tolylpyrene-1-amine, N,N-di-p-tolyl-1-naphthylamine, N,N-di-p-tolyl-1-phenanthrylamine, 9,9-dimethyl-2-(di-p-tolylamino)fluorene, N,N,N',N'-tetrakis(4-methylphenyl)-phenanthrene-9,10-diamine, and N,N,N',N'-tetrakis(3-methylphenyl)-m-phenylenediamine.

Examples of the compound represented by the general formula (21) include 1,4-bis(4-diphenylaminostyryl)benzene, and 1,4-bis[4-(di-p-tolylamino)styryl]benzene.

Examples of the compound represented by the general formula (22) include 1-(4-diphenylaminostyryl)pyrene, and 1-(N,N-di-p-tolyl-4-aminostyryl)pyrene.

The low molecular electron transport material is not particularly limited, and examples thereof include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno4H-indeno[1,2-b]thiophen-4-one, 1,3,7-trinitrodibenzothiophene-5,5-dioxide, and compounds represented by the general formulae (23) to (28).

General Formula (23)

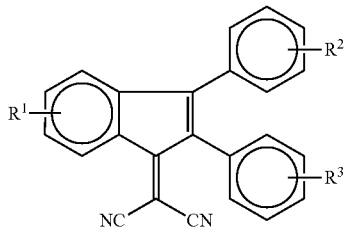

In the formula above, $R^1$, $R^2$, and $R^3$ are each independently a hydrogen atom, a halogen atom, a substituted or unsubstituted alkyl group, an alkoxy group, or a substituted or unsubstituted phenyl group.

General Formula (24)

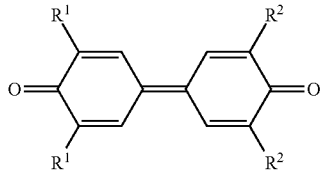

In the formula above, $R^1$ and $R^2$ are each independently a hydrogen atom, a substituted or unsubstituted alkyl group, or a substituted or unsubstituted phenyl group.

General Formula (25)

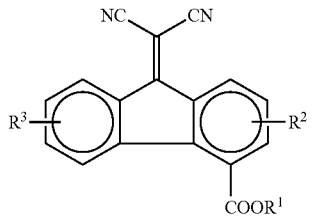

In the formula above, $R^1$ and $R^2$ are each independently a hydrogen atom, a substituted or unsubstituted alkyl group, or a substituted or unsubstituted aromatic hydrocarbon group.

A mass ratio of the low molecular charge transport material to the binder resin is typically 0.3 to 2.0.

The high molecular charge transport material is not particularly limited, and examples thereof include polycarbonate containing a triarylamine structure in its principle chain and/or side chain. Among them, preferred are compounds represented by the following general formulae (29) to (39).

General Formula (29)

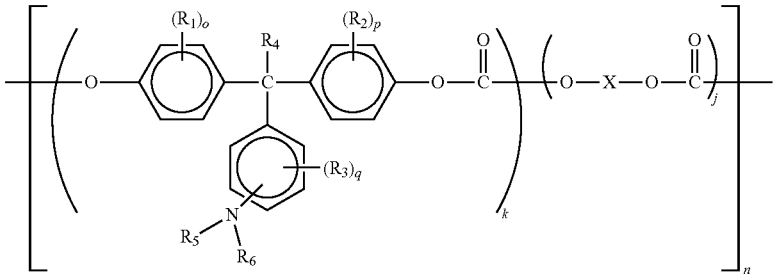

In the formula above, $R^1$, $R^2$, and $R^3$ are each independently a hydrogen atom, a halogen atom, a substituted or unsubstituted alkyl group, an alkoxy group, or a phenyl group that may be substituted with a substituent.

General Formula (26)

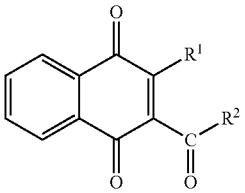

In the formula above, $R^1$ and $R^2$ are each independently a substituted or unsubstituted alkyl group, or a substituted or unsubstituted aryl group.

General Formula (27)

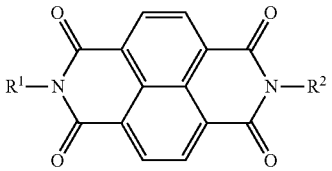

In the formula above, $R^1$ and $R^2$ are each independently a hydrogen atom, a substituted or unsubstituted alkyl group, or a substituted or unsubstituted aromatic hydrocarbon group.

General Formula (28)

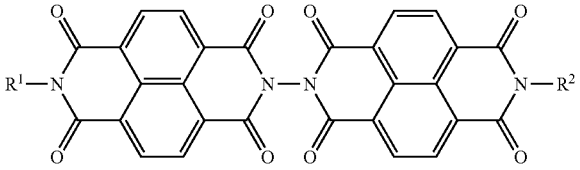

In the formula above, $R^1$, $R^2$, and $R^3$ are each independently a substituted or unsubstituted an alkyl group, or a halogen atom; $R_4$ is a hydrogen atom, or a substituted or unsubstituted alkyl group; $R_5$ and $R_6$ are each independently a substituted or unsubstituted aryl group; X is an alkylene group, a cycloalkylene group, or any of compounds represented by the following general formulae; k is 0.1 to 1, where a sum of k and j is 1; n is 5 to 5,000; o, p, and q are each independently and an integer of 0 to 4, and a plurality of $R_1$, $R_2$, or $R_3$ may be the same or different, when o, p, or q is an integer of 2 or greater.

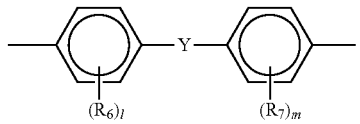

In the formula above, $R_6$ and $R_7$ are each independently a substituted or unsubstituted alkyl group, an aryl group, or a halogen atom; Y is a single bond, a C1-C12 alkylene group, a C1-C12 cycloalkylene group, an oxygen atom, a sulfur atom, a sulfinyl group, a sulfonyl group, a carbonyl group, or a group represented by the general formula:

—COO—Z—OCO— where Z is an alkylene group; and 1 and m are each independently an integer of 0 to 4, and a plurality of $R_6$ or $R_7$ may be the same or different, when l or m is an integer of 2 or greater.

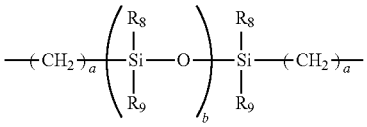

In the formula above, $R_8$ and $R_9$ are each independently a substituted or unsubstituted alkyl group, or an aryl group; a is an integer of 1 to 20; and b is an integer of 1 to 2,000.

General Formula (30)

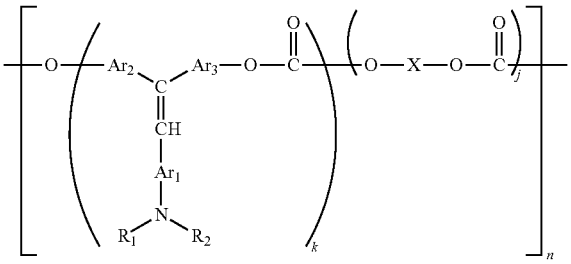

In the formula above, $R_1$ and $R_2$ are each independently a substituted or unsubstituted aryl group; $Ar_1$, $Ar_2$, and $Ar_3$ are each independently an arylene group; and X, k, j, and n are the same as in the general formula (29).

General Formula (31)

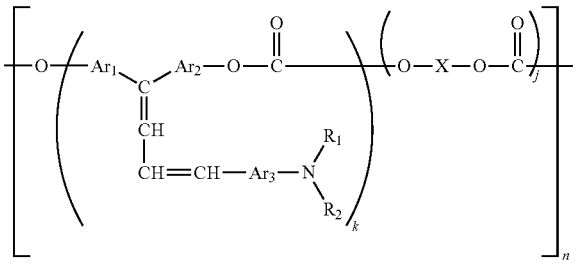

In the formula above, $R_1$ and $R_2$ are each independently a substituted or unsubstituted aryl group; $Ar_1$, $Ar_2$, and $Ar_3$ are each independently an arylene group; and X, k, j, and n are the same as in the general formula (29).

General Formula (32)

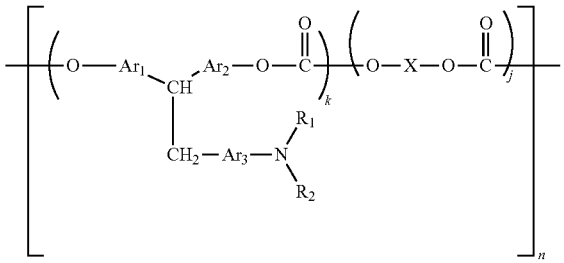

In the formula above, $R_1$ and $R_2$ are each a substituted or unsubstituted aryl group; $Ar_1$, $Ar_2$, and $Ar_3$ are each independently an arylene group; p is an integer of 1 to 5; and X, k, j, and n are the same as in the general formula (29).

General Formula (33)

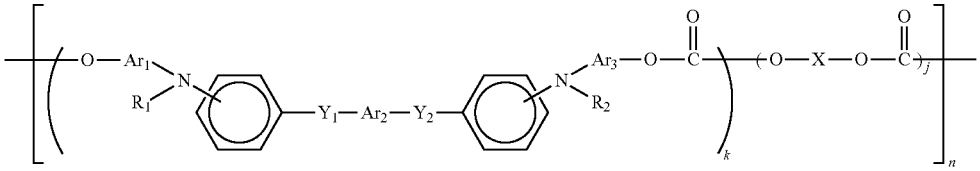

In the formula above, $R_1$ and $R_2$ are each a substituted or unsubstituted aryl group; $Ar_1$, $Ar_2$, and $Ar_3$ are each independently an arylene group; $Y_1$ and $Y_2$ are each independently a substituted or unsubstituted ethylene group, or a substituted or unsubstituted vinylene group; and X, k, j, and n are the same as in the general formula (29).

General Formula (34)

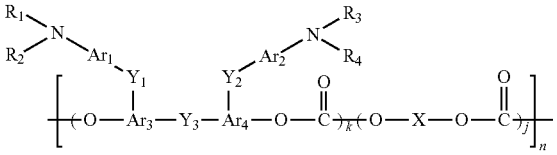

In the formula above, $R_1$, $R_2$, $R_3$, and $R_4$ are each independently a substituted or unsubstituted aryl group; $Ar_1$, $Ar_2$, $Ar_3$, and $Ar_4$ are each independently an arylene group; $Y_1$, $Y_2$, and $Y_3$ are each independently a single bond, a substituted or unsubstituted alkylene group, a substituted or unsubstituted cycloalkylene group, a substituted or unsubstituted alkylene group, an oxygen atom, a sulfur atom, or a vinylene group; and X, k, j, and n are the same as in the general formula (29).

General Formula (35)

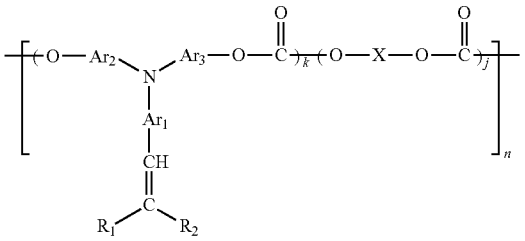

In the formula above, $R_1$ and $R_2$ are each independently a hydrogen atom, or a substituted or unsubstituted aryl group, where $R_1$ and $R_2$ may bond to each other to form a ring; $Ar_1$, $Ar_2$, and $Ar_3$ are each independently an arylene group; and X, k, j, and n are the same as in the general formula (29).

In the formula above, $R_1$ and $R_2$ are each independently a substituted or unsubstituted aryl group; $Ar_1$, $Ar_2$, $Ar_3$, and $Ar_4$ are each independently an arylene group; $Z_1$ is an arylene group, or a group represented by the general formula:

$$-Ar_5-Z_2-Ar_5-$$

where $Ar_5$ is an arylene group, and $Z_2$ is an oxygen atom, a sulfur atom, or an alkylene group; $Y_1$ and $Y_2$ are each an alkylene group; m is 0 or 1; and X, k, j, and n are the same as in the general formula (29).

The photoconductive layer 12 may further contain phenol, hydroquinone, hindered phenol, hindered amine, or a compound containing both a hindered amine structure and a hindered phenol structure, for the purpose of improving charging ability.

A thickness of the photoconductive layer is typically 10 μm to 100 μm.

General Formula (36)

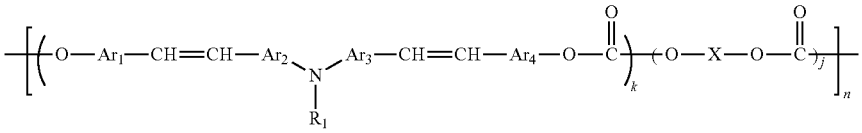

In the formula above, $R_1$ is a substituted or unsubstituted aryl group; $Ar_1$, $Ar_2$, $Ar_3$, and $Ar_4$ are each independently an arylene group; and X, k, j, and n are the same as in the general formula (29).

General Formula (37)

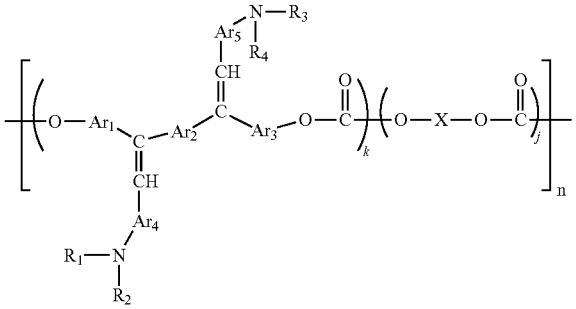

In the formula above, $R_1$, $R_2$, $R_3$, and $R_4$ are each independently a substituted or unsubstituted aryl group; $Ar_1$, $Ar_2$, $Ar_3$, $Ar_4$ and $Ar_5$ are each independently an arylene group; and X, k, j, and n are the same as in the general formula (29).

General Formula (38)

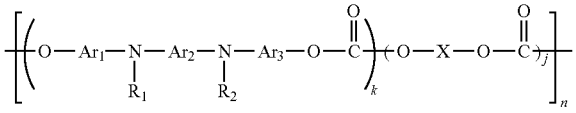

In the formula above, $R_1$ and $R_2$ are each independently a substituted or unsubstituted aryl group; $Ar_1$, $Ar_2$, and $Ar_3$ are each independently an arylene group; and X, k, j, and n are the same as in the general formula (29).

The photoconductive layer 12 can be formed by applying a coating liquid, in which a composition containing a compound represented by the general formula (1), the charge transport material, and the binder resin are dissolved or dispersed in a solvent, followed by drying the coating liquid.

The solvent is not particularly limited, and examples thereof include N,N-dimethylformamide, toluene, xylene, monochlorobenzene, 1,2-dichloroethane, 1,1,1-trichloroethane, dichloromethane, 1,1,2-trichloroethane, trichloroethylene, tetrahydrofuran, methyl ethyl ketone, methyl isobutyl ketone, cyclohexanone, ethyl acetate, butyl acetate, and dioxane.

A disperser used for dissolving or dispersing the composition in the solvent is not particularly limited, and examples thereof include a ball mill, an ultrasonic disperser, and a homomixer.

A coating method of the coating liquid is not particularly limited, and examples thereof include dip coating, blade coating, and spray coating.

Note that, a photoconductive layer having a laminate structure, where a charge generation layer and a charge transport layer are laminated, may be formed instead of the photoconductive layer 12.

The charge generation layer contains a compound represented by the general formula (1) and a binder resin.

The charge generation layer preferably contains a compound represented by the general formula (2) in combination with the compound represented by the general formula (1), and more preferably contains a reaction product between the compound represented by the general formula (2) and a compound represented by the general formula (3).

A mass ratio of the compounds represented by the general formulae (1) and (2) to the binder resin is typically 0.20 or greater.

General Formula (39)

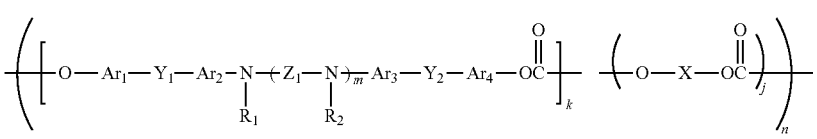

A thickness of the charge generation layer is typically 0.01 μm to 5 μm.

The charge transport layer contains a charge transport material and a binder resin.

A mass ratio of the charge transport material to the binder resin in the charge transport layer is typically 0.20 to 2.00.

The charge generation layer preferably further contains a charge transport material. Use of the charge transport material in the charge generation layer can prevent generation of residual potential, and can improve sensitivity.

A mass ratio of the charge transport material to the binder resin in the charge generation layer is typically 0.20 to 2.00.

A thickness of the charge transport layer is typically 5 μm to 100 μm.

Note that, an order for laminating the charge generation layer and the charge transport layer is not particularly limited.

Moreover, the binder resin contained in the charge transport layer may be the same to or different from the binder resin contained in the charge generation layer.

The electrically conductive support 11 is not particularly limited, and examples thereof include: a metal plate, a metal drum, or a metal foil (e.g., aluminum, nickel, copper, titanium, gold, and stainless steel); a plastic film deposited with aluminum, nickel, copper, titanium, gold, tin oxide, or indium oxide; and a film or drum of paper or plastic coated with an electrically conductive material.

An undercoat layer may be further formed between the electrically conductive support 11 and the photoconductive layer 12 in order to improve adhesion, and charge blocking properties.

The undercoat layer contains a resin.

The resin is not particularly limited, provided that it has high resistance to a coating liquid that is applied when a photoconductive layer 12 is formed. Examples of the resin include: a water-soluble resin, such as polyvinyl alcohol, casein, and sodium polyacrylate; an alcohol-soluble resin, such as copolymer nylon, and methoxy methylated nylon; and a hardening resin, such as polyurethane, a melamine resin, a phenol resin, an alkyd-melamine resin, and an epoxy resin.

The undercoat layer may further contain a powder of metal oxide to prevent interference fringes, and to reduce residual potential.

The metal oxide is not particularly limited, and examples thereof include titanium oxide, silica, alumina, zirconium oxide, thin oxide, and indium oxide.

In the same manner as the formation of the photoconductive layer 12, the undercoat layer can be formed by applying a coating liquid, in which a composition containing a resin is dissolved or dispersed in a solvent, followed by drying the coating liquid.

Note that, the undercoat layer can be also formed by using a silane coupling agent, a titanium coupling agent, or a chromium coupling agent.

Moreover, the undercoat layer can be also formed by anodding the electrically conductive support 11 formed of aluminum.

Furthermore, it is possible to form an undercoat layer containing an organic material, such as polyparaxylylene (parylene), or an inorganic material, such as $SiO_2$, $SnO_2$, $TiO_2$, ITO, and $CeO_2$, can be formed by a vacuum thin film forming technique.

A thickness of the undercoat layer is typically 0.01 μm to 5 μm.

A protective layer may be further formed on the photoconductive layer 12 in order to improve abrasion resistance.

The protective layer contains a resin.

The resin is not particularly limited, and examples thereof include an ABS resin, an ACS resin, an olefin-vinyl monomer copolymer, chlorinated polyester, an allyl resin, a phenol resin, polyacetal, polyamide, polyamide imide, polyacrylate, polyallyl sulfone, polybutylene, polybutylene terephthalate, polycarbonate, polyether sulfone, polyethylene, polyethylene terephthalate, polyimide, an acrylic resin, polymethyl bentene, polypropylene, polyphenylene oxide, polysulfone, polystyrene, an AS resin, a butadiene-styrene copolymer, polyurethane, polyvinyl chloride, polyvinylidene chloride, an epoxy resin, a fluororesin (e.g., polytetrafluoroethylene), and a silicone resin.

The protective layer may further contain inorganic particles or organic particles, in order to improve abrasion resistance or release properties.

The inorganic particles are not particularly limited, and examples thereof include titanium oxide, tin oxide, potassium titanate, alumina, and silica.

The organic particles are not particularly limited, and examples thereof include fluororesin particles (e.g., polytetrafluoroethylene particles), and silicone resin particles.

In the same manner as the formation of the photoconductive layer 12, the protective layer can be formed by applying a coating liquid, in which a composition containing a resin is dissolved or dispersed in a solvent, and drying the coating liquid.

A coating method of the coating liquid is not particularly limited, and examples thereof include dip coating, spray coating, bead coating, nozzle coating, spinner coating, and ring coating. Among them, spray coating is preferable in view of uniformity of a coating film.

Note that, a protective layer containing a-C or a-SiC can be formed by a vacuum thin film forming technique.

A thickness of the protective layer is typically about 0.1 μm to about 10 μm.

(Image Forming Apparatus)

Figure 2:
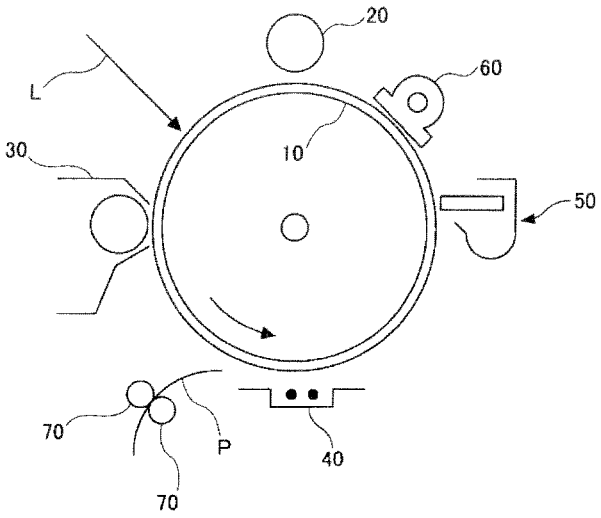
FIG. 2 is a schematic diagram illustrating one example of an image forming apparatus.

FIG. 2 illustrates one example of an image forming apparatus.

In FIG. 2, the photoconductor 10 rotates in the direction depicted with the arrow, and a charging member 20, an exposing member (not illustrated), a developing member 30, a transferring member 40, a cleaning member 50, and a diselectrification member 60 are provided in the surrounding area of the photoconductor 10.

Note that, the cleaning member 50, and the diselectrification member 60 may be omitted sometime.

Next, operations of the image forming apparatus are explained.

A surface of the photoconductor 10 is substantially uniformly charged by the charging member 20. Next, light L corresponding to an input signal is applied by the exposing member to thereby form an electrostatic latent image. Moreover, the electrostatic latent image is developed by the developing member 30, to thereby form a toner image on the surface of the photoconductor 10. The toner image is transferred onto a sheet P, which has been conveyed by a pair of registration rollers 70, by the transferring member 40. The toner image is then fixed onto the sheet P by a fixing device (not illustrated). Part of the toner, which has not been transferred to the sheet P, is cleaned by the cleaning member 50. Next, the residual charge on the photoconductor 10 is discharged by the diselectrification member 60, and then the photoconductor 10 is moved onto a next cycle.

The photoconductor 10 is in the form of a drum, but the photoconductor 10 may be in the form of a sheet, or an endless belt.

The charging member 20, and the transferring member 40 are not particularly limited, and examples thereof include corotron, scorotron, a solid state charger, a roller charging member, and a brush charging member.

Examples of a light source of the exposing member, or the diselectrification member 60 include a fluorescent lamp, a tungsten lamp, a halogen lamp, a mercury lamp, a sodium lamp, a light-emitting diode (LED), a laser diode (LD), and an electroluminescent (EL) lamp. Among them, preferred are a laser diode (LD), and a light-emitting diode (LED).

Note that, a filter may be also used to apply only light of the desired wavelength range.

The filter is not particularly limited, and examples thereof include a sharp-cut filter, a band filter, a near infrared-cut filter, a dichroic filter, an interference filter, and a color temperature conversion filter.

When light L is applied after positively (or negatively) charging a surface of the photoconductor 10, a positive (or negative) electrostatic latent image is formed on the surface of the photoconductor 10. When the electrostatic latent image is developed with a toner having a polarity of negative (or positive), a positive image is formed. When the electrostatic latent image is developed with a toner having a polarity of positive (or negative), a negative image is formed.

The cleaning member 50 is not particularly limited, and examples thereof include a cleaning blade, and a cleaning brush. They may be used in combination.

Figure 3:
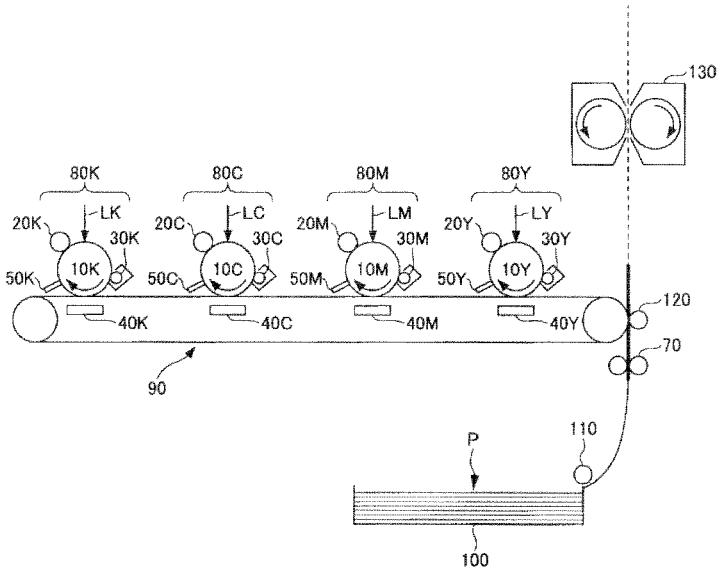
FIG. 3 is a schematic diagram illustrating another example of an image forming apparatus.

As another example of the image forming apparatus, a tandem full-color electrophotographic device is illustrated in FIG. 3.

In FIG. 3, the photoconductors 10C, 10M, 10Y, 10K are each in the form of a drum, and rotate in the direction depicted with the arrow. In the surrounding area of the photoconductors 10C, 10M, 10Y, 10K, provided are charging members 20C, 20M, 20Y, 20K, developing members 30C, 30M, 30Y, 30K, and cleaning members 50C, 50M, 50Y, 50K.

Light LC, LM, LY, LK is applied to the photoconductors 10C, 10M, 10Y, 10K respectively provided between the charging members 20C, 20M, 20Y, 20K, and the developing members 30C, 30M, 30Y, 30K from exposing members (not illustrated), to thereby form electrostatic latent images.

An image forming units 80C, 80M, 80Y, 80K respectively composed with the photoconductors 10C, 10M, 10Y, 10K as a center are provided along a transfer convey belt 90.

The transfer convey belt 90 is in contact with the photoconductors 10C, 10M, 10Y, 10K at the positions between the developing members 30C, 30M, 30Y, and 30K, and the cleaning members 50C, 50M, 50Y, 50K of the image forming units 80C, 80M, 80Y, 80K. Moreover, transferring members 40C, 40M, 40Y, 40K each configured to apply transfer bias are provided on the plane of the transfer convey belt 90 where the photoconductors 10C, 10M, 10Y, 10K are not provided.

Note that, the image forming units 80C, 80M, 80Y, 80K have the same structure, provided that a color of the toner for use is different.

Next, image forming operations of the tandem full-color electrophotographic device are explained.

In the image forming units 80C, 80M, 80Y, 80K, first, the photoconductors 10C, 10M, 10Y, 10K are respectively changed by the charging members 20C, 20M, 20Y, 20K, which respectively rotate in the drag turning direction with respect to the photoconductors 10C, 10M, 10Y, 10K, and then light LC, LM, LY, LK is applied thereon from exposing members which are provided at the outer side of the photoconductors 10C, 10M, 10Y, 10K, to thereby form electrostatic latent images respectively corresponding to colors of an image to be formed.

Next, the electrostatic latent images are respectively developed with the developing members 30C, 30M, 30Y, 30K, to form toner images. The developing member 30C, 30M, 30Y, 30K develop the electrostatic latent images with toners of cyan (C), magenta (M), yellow (Y), and black (K), respectively. The toner images of these colors formed on the photoconductors 10C, 10M, 10Y, 10K, are transferred to the transfer convey belt 90 and superimposed.

After feeding the sheet P from a paper feeding tray 100 by a paper feeding roller 110, the sheet P is temporarily stopped by a pair of registration rollers 70, and is then transferred to the transferring member 120 to mach the timing with the superimposed toner image on the transfer convey belt 90. The superimposed toner image on the transfer convey belt 90 is transferred to the sheet P by an electric field formed by a difference between transfer bias applied to the transferring member 120 and the electric potential of the transfer convey belt 90. The sheet P, to which the toner image has been transferred, is conveyed, and the toner image is fixed onto the sheet P by the fixing member 130, followed by discharging the sheet P to a discharge tray (not illustrated).

Moreover, the toner remained on the photoconductors 10C, 10M, 10Y, 10K without being transferred to the transfer convey belt 90 is collected by the cleaning members 50C, 50M, 50Y, 50K.

Note that, an intermediate transfer body in the form of a drum may be used instead of a transfer convey belt 90.

Moreover, an order for providing the image forming units 80C, 80M, 80Y, 80K is not particularly limited.

In the case where an image of only black is formed, moreover, a system configured to stop the image forming units 80C, 80M, 80Y may be provided.

The image forming units 80C, 80M, 80Y, 80K may be incorporated into the image forming apparatus by fixing the image forming units therein. Alternatively, the image forming units 80C, 80M, 80Y, 80K may be each incorporated in the image forming apparatus in the form of a process cartridge.

Figure 4:
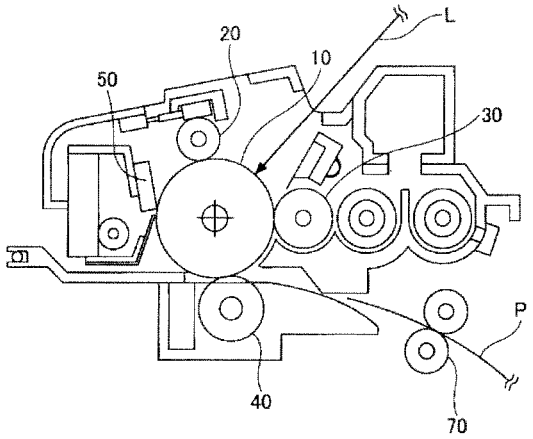
FIG. 4 is a schematic diagram illustrating one example of a process cartridge.

One example of the process cartridge is illustrated in FIG. 4.

The process cartridge has a photoconductor 10 built-in, and contains a charging member 20, an exposing member (not illustrated), a developing member 30, a transferring member 40, a cleaning member 50, and a diselectrification member (not illustrated).

The image forming apparatus is not particularly limited, and examples thereof include a photocopier, a facsimile, and a printer.

Note that, a compound represented by the general formula (1), and a composition containing compounds represented by the general formulae (1) and (2) can be also applied for an electronic device of an electronics field, such as a solar cell, and an optical disc, other than use as a charge generation material of a photoconductor.

EXAMPLES

Examples of the present invention are explained hereinafter, but Examples shall not be construed as to limit the scope of the present invention.

Synthesis of Alizarin Adduct of Titanium Phthalocyanine

After refluxing and stirring 2.50 g (4.34 mmol) of amorphous titanyl phthalocyanine, 1.04 g (4.34 mmol) of alizarin, and 50 mL of 1,2-dichlorobenzene for 6 hours at 164° C. to 165° C., the resultant was left to stand over night at room temperature. Subsequently, the resultant was poured into about 250 mL of methanol, which was stirred in a beaker, and the resulting mixture was stirred for 30 minutes at room temperature, followed by subjecting to filtration. Moreover, the resultant was stirred in about 250 mL of methanol, about 250 mL of toluene, about 250 mL of N,N-dimethylformamide, about 250 mL of ion-exchanged water, and about 250 mL of methanol, respectively in this order, each in a beaker, followed by subjecting to filtration. Next, the resultant was heated under the reduced pressure to dry for 2 days, to thereby 3.39 g of an alizarin adduct of titanium phthalocyanine (yield: 98.0%).

In the MALDI-TOF mass spectrum, a molecular ion peak (m/z=798.11) of an alizarin adduct of titanium phthalocyanine ($C46H_{22}N_8O_4Ti$) was observed.

Figure 5:
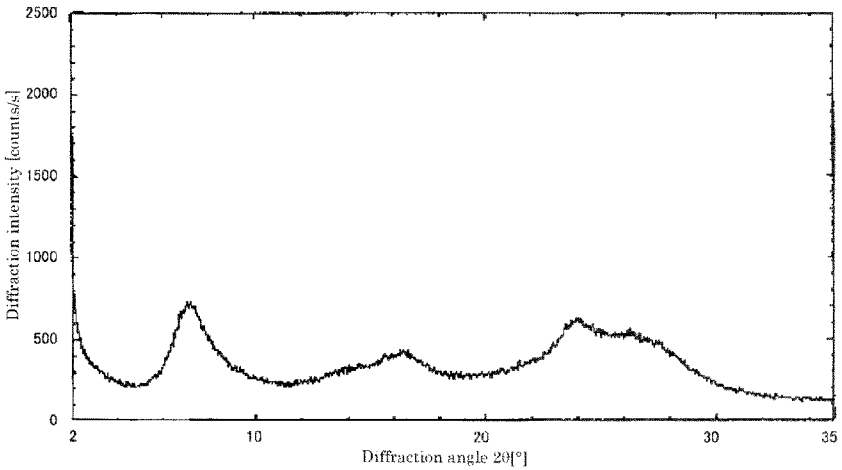
FIG. 5 is an X-ray diffraction spectrum of amorphous titanyl phthalocyanine.

FIG. 5 depicts an X-ray diffraction spectrum of the amorphous titanyl phthalocyanine.

Figure 6:
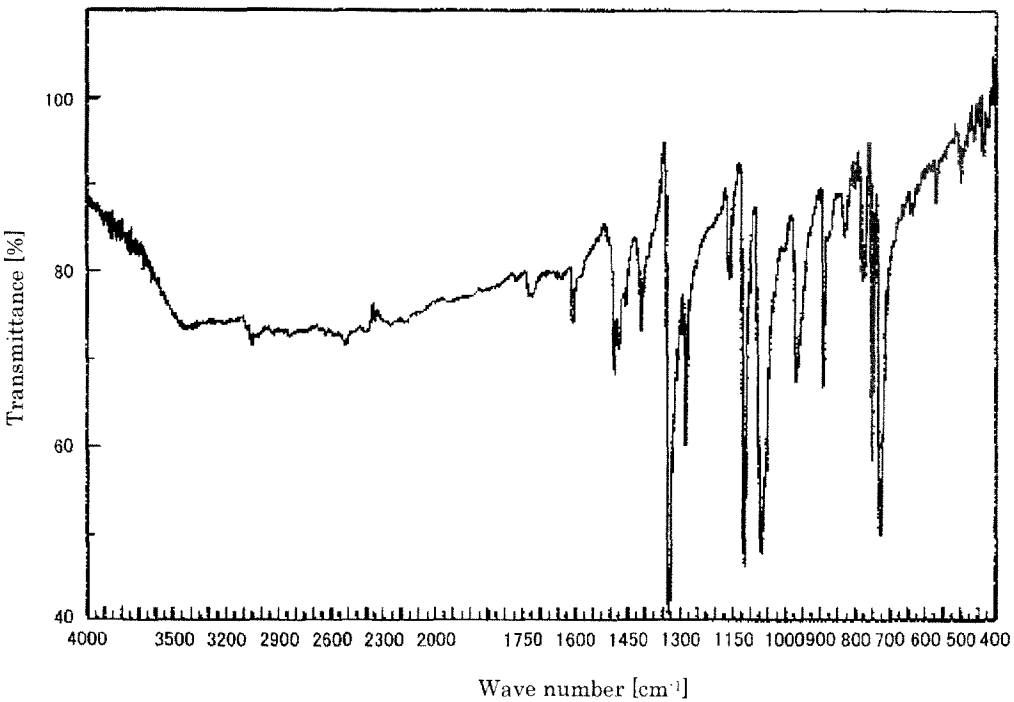
FIG. 6 is an infrared absorption spectrum of amorphous titanyl phthalocyanine.

FIG. 6 depicts an infrared absorption spectrum (a KBr disc method) of the amorphous titanyl phthalocyanine.

Figure 7:
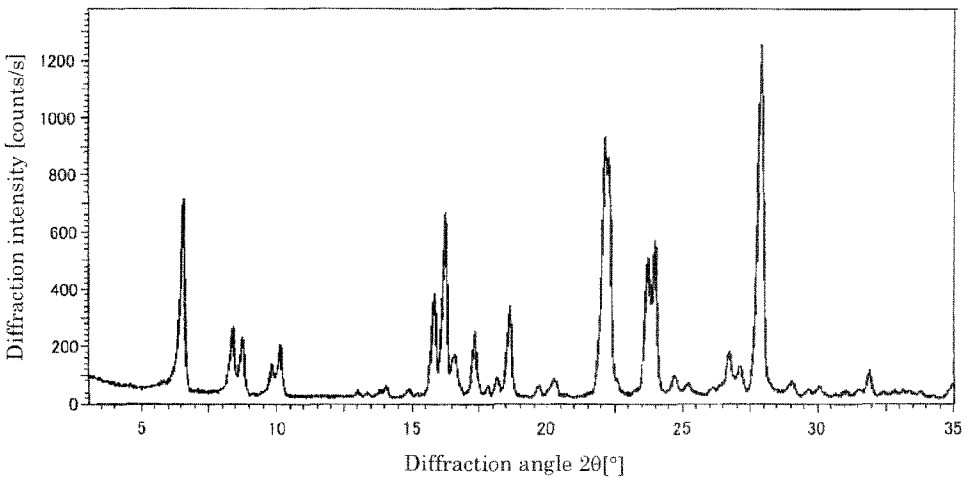
FIG. 7 is an X-ray diffraction spectrum of an alizarin adduct of titanium phthalocyanine.

FIG. 7 depicts an X-ray diffraction spectrum of the alizarin adduct of titanium phthalocyanine.

Figure 8:
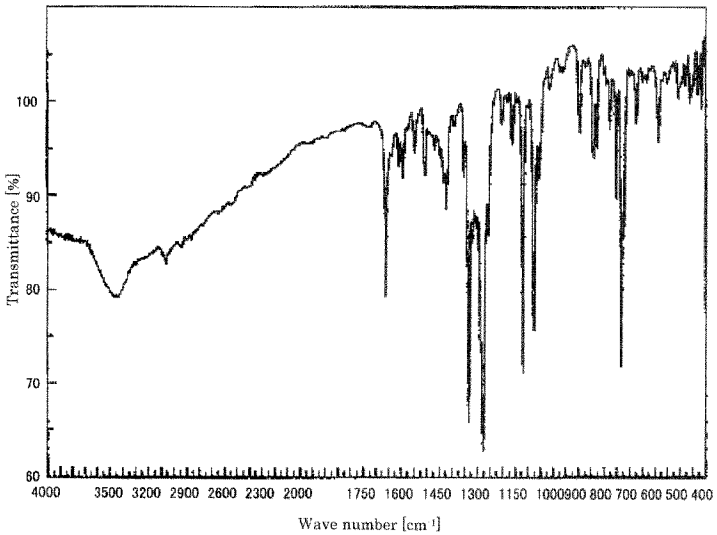
FIG. 8 is an infrared absorption spectrum of an alizarin adduct of titanium phthalocyanine.

FIG. 8 depicts an infrared absorption spectrum (a KBr disc method) of the alizarin adduct of titanium phthalocyanine.

It could be understood from FIG. 8 that a peak (970 $cm^{-1}$) of Ti═O stretching vibration of the amorphous titanyl phthalocyanine is disappeared, and a peak (1,660 $cm^{-1}$) of C═O stretching vibration of the alizarin adduct of titanium phthalocyanine is present.

Synthesis of Mixture 1 of Alizarin Adduct of Titanium Phthalocyanine and Titanyl Phthalocyanine Mixture 1 (2.87 g) of an alizarin adduct of titanium phthalocyanine and titanyl phthalocyanine was obtained (yield: 96.3%) in the same manner as in the synthesis of the alizarin adduct of titanium phthalocyanine, provided that the amount of alizarin was changed to 0.52 g (2.17 mmol).

In the MALDI-TOF mass spectrum, a molecular ion peak (m/z=798.11) of the alizarin adduct of titanium phthalocyanine ($C46H_{22}N_8O_4Ti$) was observed.

Figure 9:
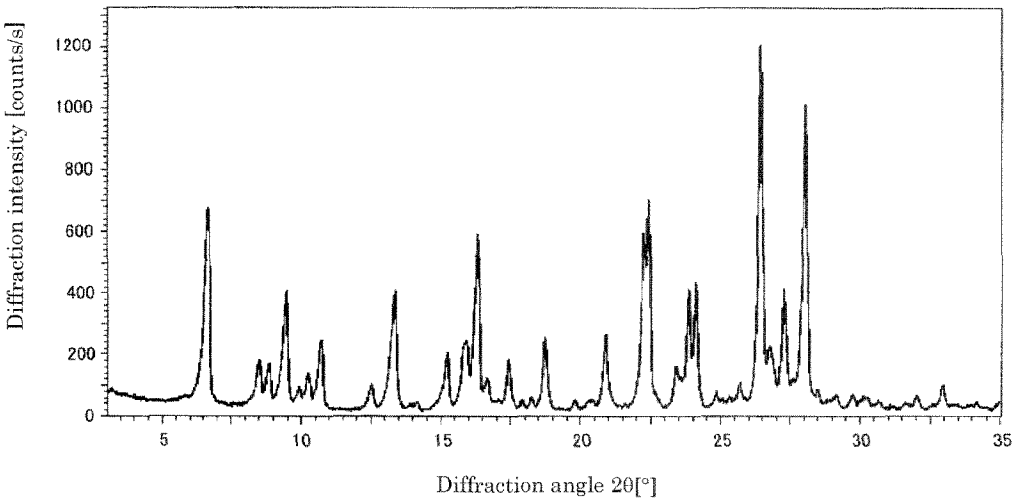
FIG. 9 is an X-ray diffraction spectrum of Mixture 1.

FIG. 9 depicts an X-ray diffraction spectrum of Mixture 1.

Figure 10:
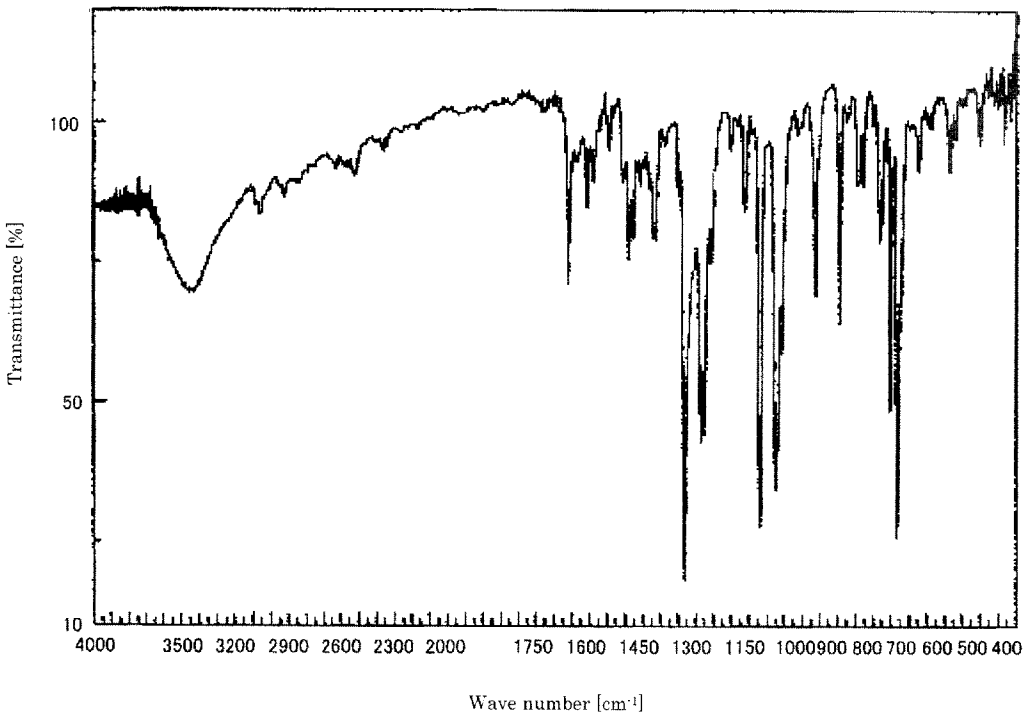
FIG. 10 is an infrared absorption spectrum of Mixture 1.

FIG. 10 depicts an infrared absorption spectrum (a KBr disc method) of Mixture 1.

It can be understood from FIG. 10 that a peak (963 $cm^{-1}$) of Ti═O stretching vibration of the amorphous titanyl phthalocyanine, and a peak (1,660 $cm^{-1}$) of C═O stretching vibration of the alizarin adduct of titanium phthalocyanine are present.

Synthesis of Mixture 2 of Alizarin Adduct of Titanium Phthalocyanine and Titanyl Phthalocyanine Mixture 2 (2.47 g) of an alizarin adduct of titanium phthalocyanine and titanyl phthalocyanine was obtained (yield: 95.0%) was obtained in the same manner as the synthesis of the alizarin adduct of titanium phthalocyanine, provided that the amount of alizarin was changed to 0.10 g (0.43 mmol).

In the MALDI-TOF mass spectrum, a molecular ion peak (m/z=798.11) of the alizarin adduct of titanium phthalocyanine ($C46H_{22}N_8O_4Ti$) was observed.

Figure 11:
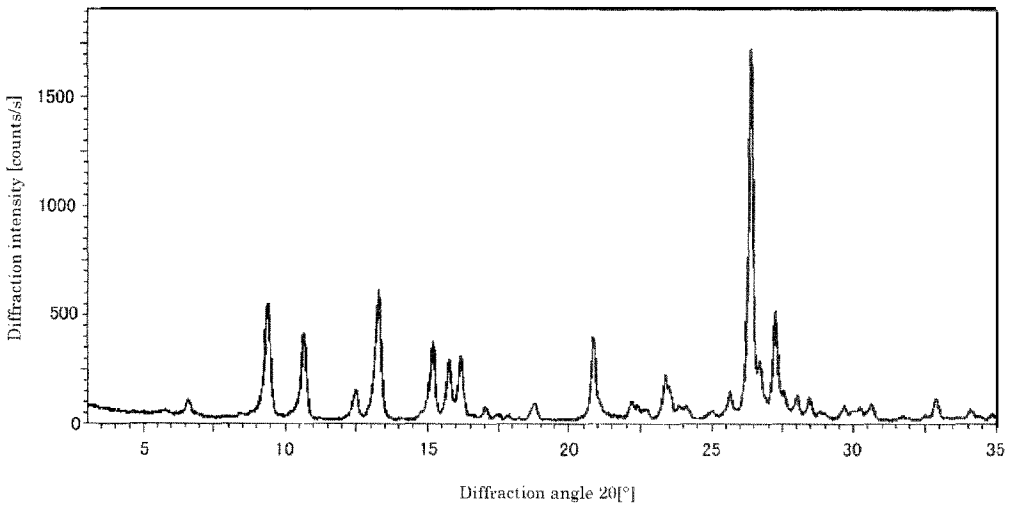
FIG. 11 is an X-ray diffraction spectrum of Mixture 2.

FIG. 11 depicts an X-ray spectrum of Mixture 2.

Figure 12:
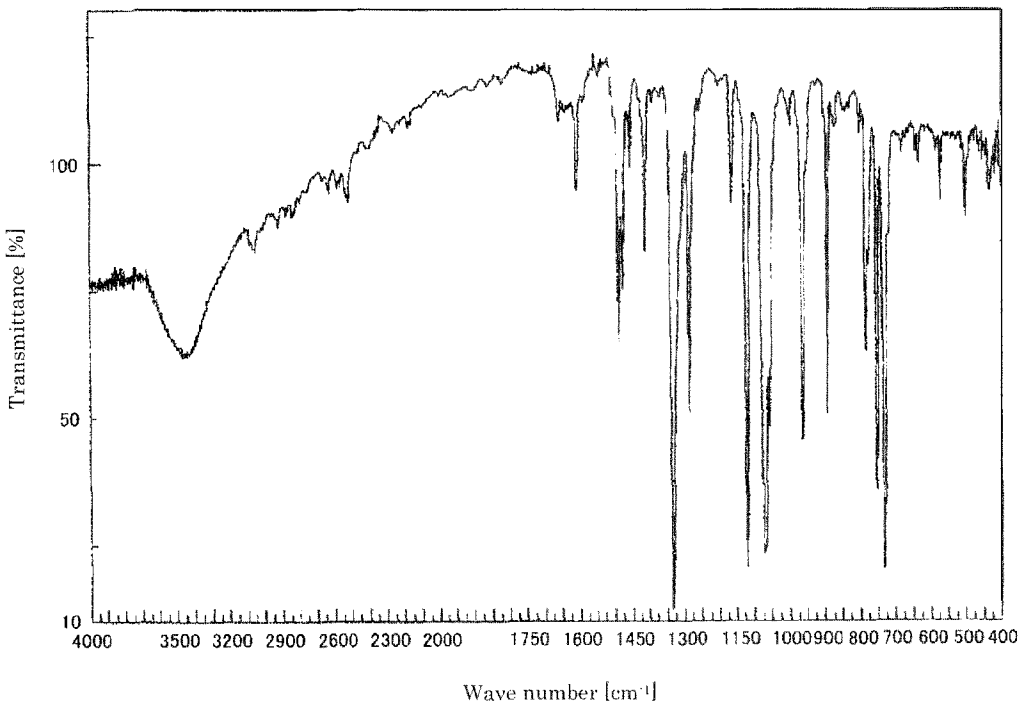
FIG. 12 is an infrared absorption spectrum of Mixture 2.

FIG. 12 depicts an infrared absorption spectrum (a KBr disc method) of Mixture 2.

It can be understood from FIG. 12 that a peak (963 $cm^{-1}$) of Ti═O stretching vibration of the amorphous titanyl phthalocyanine, and a peak (1,660 $cm^{-1}$) of C═O stretching vibration of the alizarin adduct of titanium phthalocyanine are present.

[Synthesis of Mixture 3 of Alizarin Adduct of Titanium Phthalocyanine and Titanyl Phthalocyanine]

Mixture 3 (2.42 g) of an alizarin adduct of titanium phthalocyanine and titanyl phthalocyanine was obtained (yield: 96.4%) was obtained in the same manner as the synthesis of the alizarin adduct of titanium phthalocyanine, provided that the amount of alizarin was changed to 0.01 g (0.04 mmol).

Figure 13:
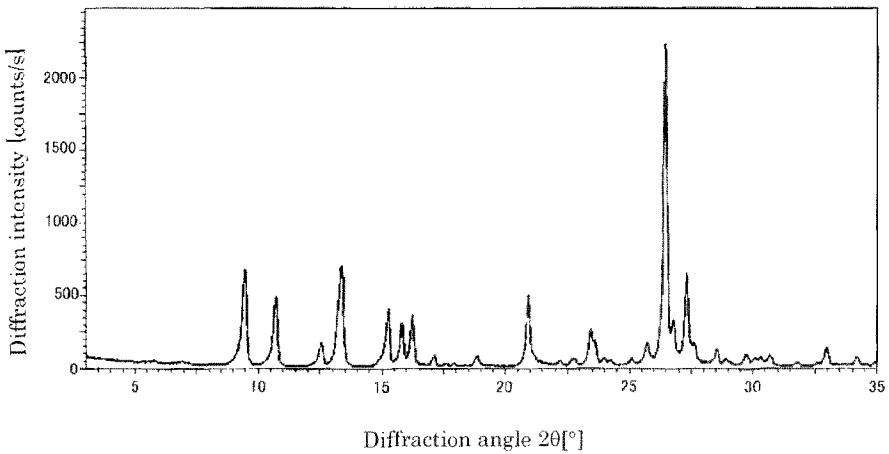
FIG. 13 is an X-ray diffraction spectrum of Mixture 3.

FIG. 13 depicts an X-ray diffraction spectrum of Mixture 3.

Figure 14:
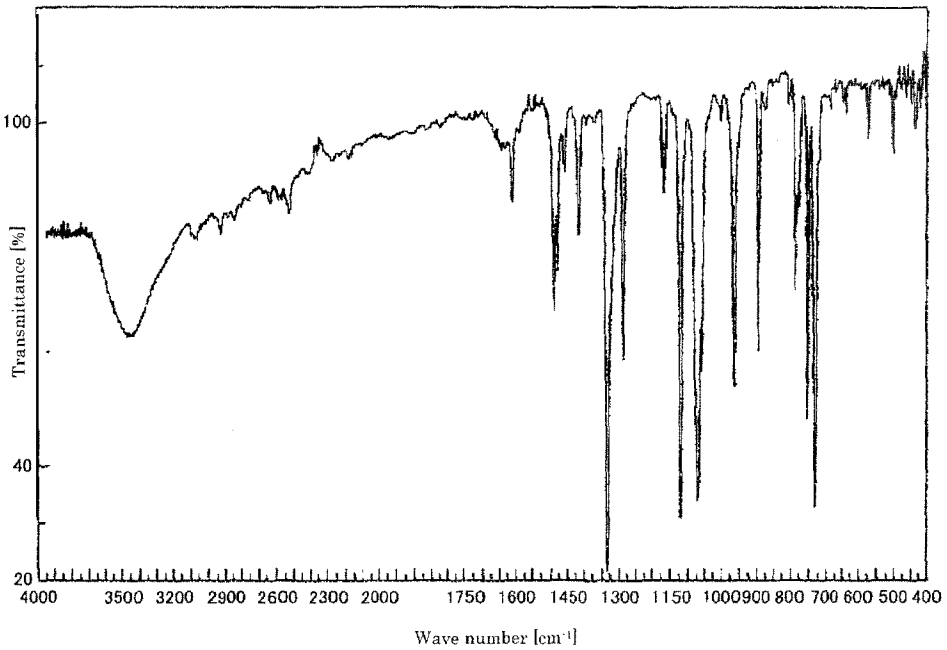
FIG. 14 is an infrared absorption spectrum of Mixture 3.

FIG. 14 depicts an infrared absorption spectrum (a KBr disc method) of Mixture 3.

It can be understood from FIG. 14 that a peak (963 $cm^{-1}$) of Ti═O stretching vibration of the amorphous titanyl phthalocyanine, and a peak (1,660 $cm^{-1}$) of C═O stretching vibration of the alizarin adduct of titanium phthalocyanine are present.

Synthesis of A-type Titanyl Phthalocyanine

A-type titanyl phthalocyanine (2.41 g) was obtained (yield: 96.4%) in the same manner as the synthesis of the alizarin adduct of titanium phthalocyanine, provided that the alizarin was not added.

Figure 15:
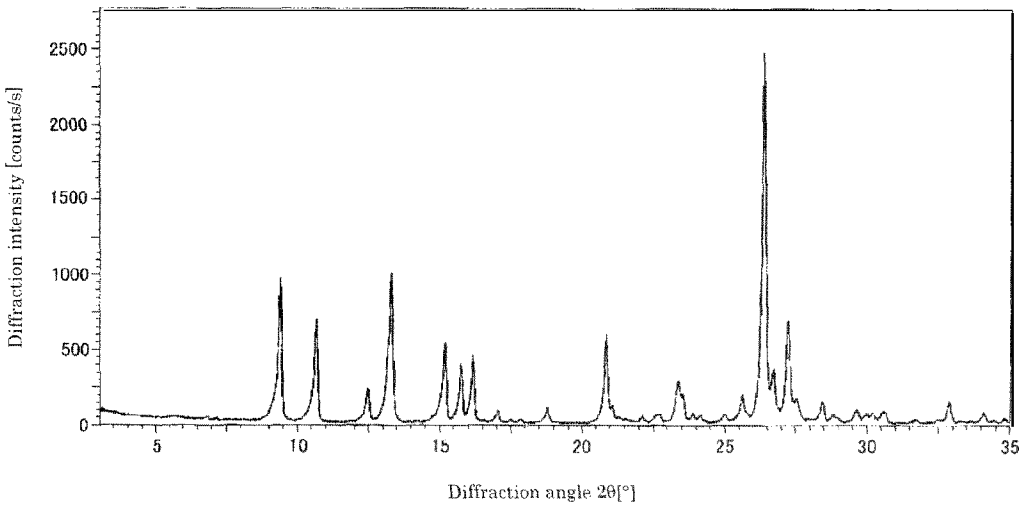
FIG. 15 is an X-ray diffraction spectrum of A-type titanyl phthalocyanine.

FIG. 15 depicts an X-ray diffraction spectrum of A-type titanyl phthalocyanine.

It can be understood from FIG. 15 that a peak pattern of A(β)-type titanyl phthalocyanine is exhibited.

Figure 16:
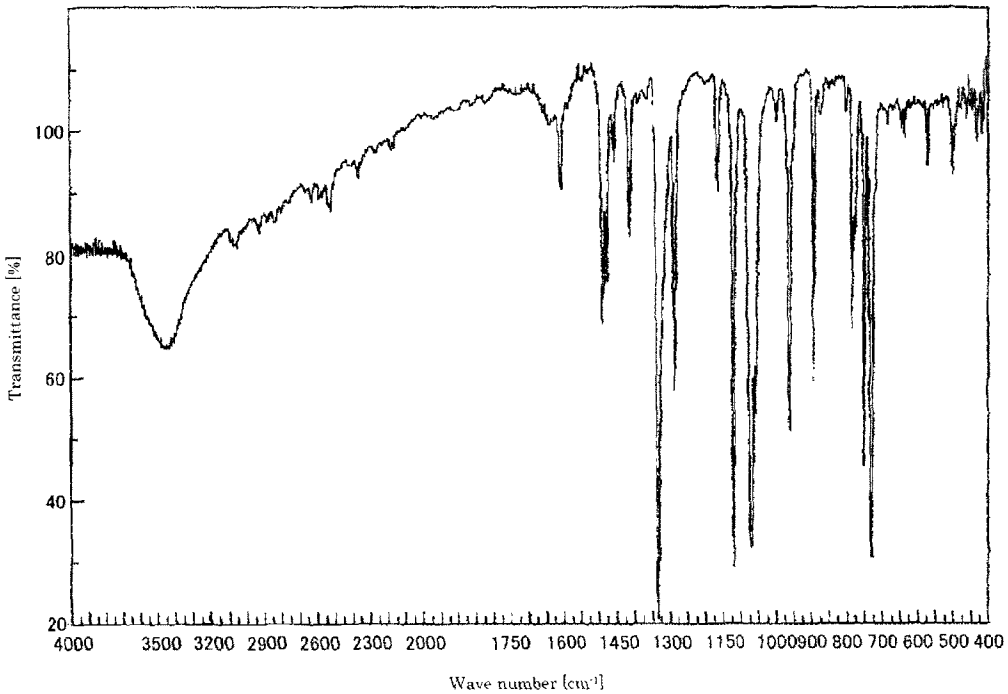
FIG. 16 is an infrared absorption spectrum of A-type titanyl phthalocyanine.

FIG. 16 depicts an infrared absorption spectrum (a KBr disc method) of A-type titanyl phthalocyanine.

Synthesis of Mixture 4 of (R,R)-(−)-2,3-Butanediol Adduct of Titanium Phthalocyanine and Titanyl Phthalocyanine After refluxing and stirring 2.50 g (4.34 mmol) of amorphous titanyl phthalocyanine, 0.313 g (3.47 mmol) of (R,R)-(−)-2,3-butanediol, and 50 mL of 1,2-dichlorobenzene for 6 hours at 164° C. to 165° C., the resultant was left to stand over night at room temperature. Subsequently, 25 mL of ion-exchanged water was added to the resultant, and the mixture was further stirred for 6 hours at 75° C. to 76° C., followed by leaving to cool to room temperature. The resultant was poured into about 250 mL of methanol, which was stirred in a beaker, and the resulting mixture was stirred for 30 minutes at room temperature, followed by subjecting to filtration. Next, the resultant was stirred in about 250 mL of methanol, about 250 mL of toluene, about 250 mL of N,N-dimethylformamide, about 250 mL of ion-exchanged water, and about 250 mL of methanol, respectively in this order, each in a beaker, followed by subjecting to filtration. The resultant was hen heated under the reduced pressure to dry for 2 days, to thereby obtain 2.53 g of Mixture 4 of the (R,R)-(−)-2,3-butanediol adduct of titanyl phthalocyanine represented by the following chemical formula, and titanyl phthalocyanine (yield: 92.0%).

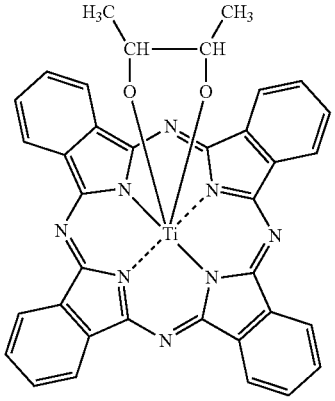

Figure 17:
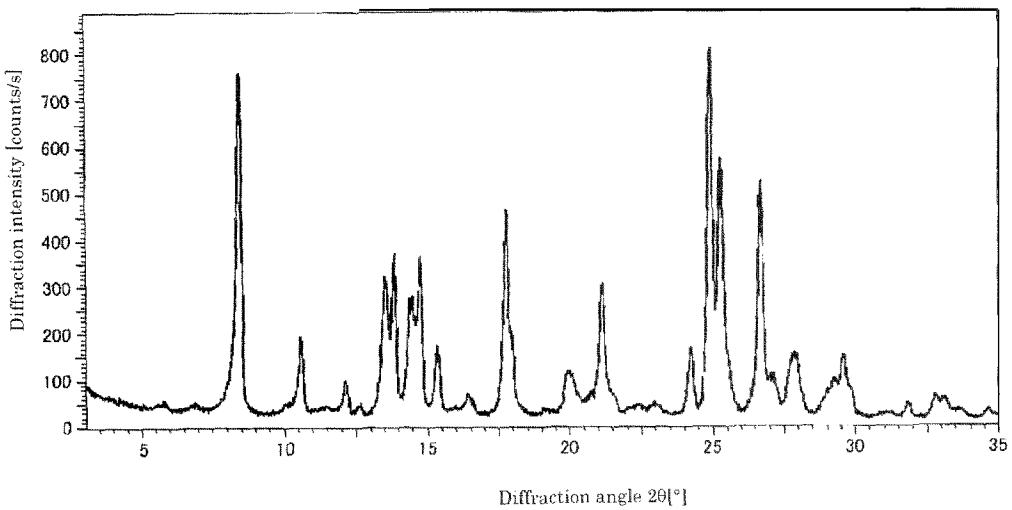
FIG. 17 is an X-ray diffraction spectrum of Mixture 4.

FIG. 17 depicts an X-ray diffraction spectrum of Mixture 4.

Figure 18:
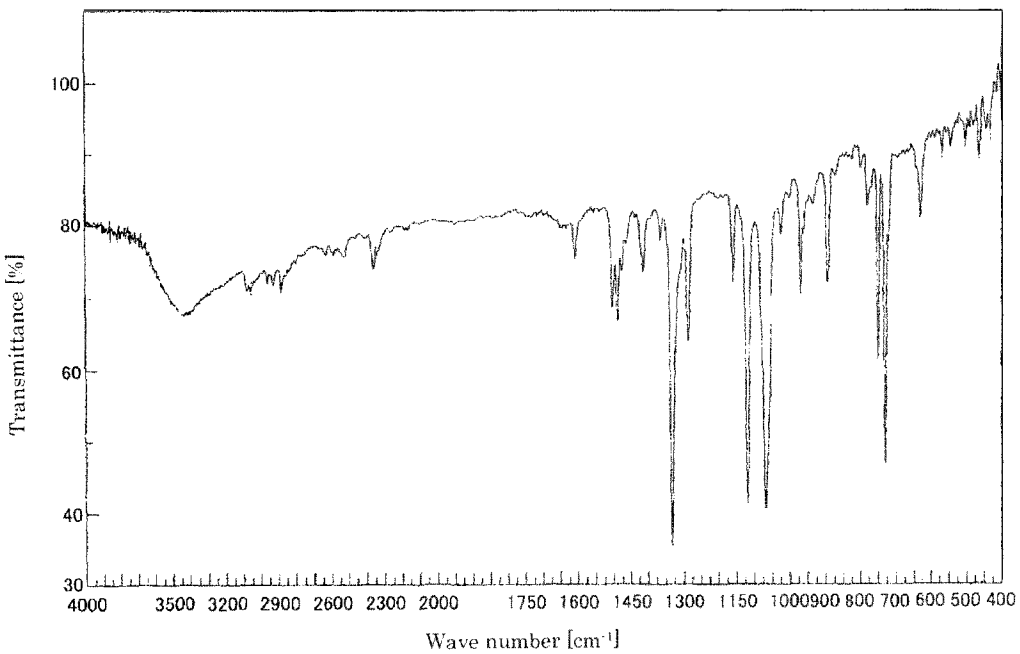
FIG. 18 is an infrared absorption spectrum of Mixture 4.

FIG. 18 depicts an infrared absorption spectrum (a KBr disc method) of Mixture 4.

It can be understood from FIG. 18 that a peak (970 $cm^{-1}$) of Ti═O stretching vibration of the titanyl phthalocyanine, and a peak (630 $cm^{-1}$) of O—Ti—O stretching vibration of the (R,R)-(−)-2,3-butanediol adduct of the titanyl phthalocyanine are present.

Example 1-1

After charging a ball mill pot with 3 parts of the alizarin adduct of titanium phthalocyanine, 2 parts of polyvinyl butyral BM-S (manufactured by SEKISUI CHEMICAL CO., LTD.), and 495 parts of methyl ethyl ketone, the resulting mixture was ball-milled for 4 hours using PSZ (partially stabilized zirconia) balls each having a diameter of 2 mm, to thereby obtain a charge generation layer coating liquid.

After applying the charge generation layer coating liquid onto an aluminum-deposited polyester film through blade coating, the coating liquid was dried for 10 minutes at 90° C., to thereby form a charge generation layer having a thickness of about 0.3 μm.

A charge transport layer coating liquid was obtained by mixing 7 parts of the low molecular hole transport material represented by the following chemical formula (A), 10 parts of polycarbonate PCX-5 (manufactured by TEIJIN LIMITED), 83 parts of tetrahydrofuran, and 0.0002 parts of silicone oil KF-50 (manufactured by Shin-Etsu Chemical Co., Ltd.).

Chemical Formula (A)

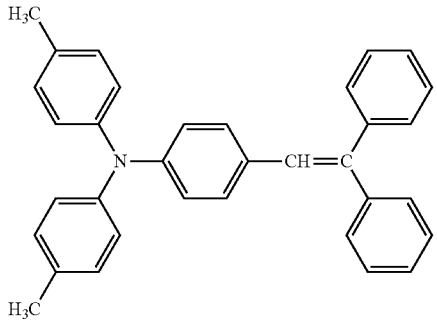

After applying the charge transport layer coating liquid onto the charge generation layer through spray coating, the coating liquid was dried for 20 minutes at 130° C. to form a charge transport layer having a thickness of about 25 μm, to thereby obtain a photoconductor.

Example 1-2

A photoconductor was obtained in the same manner as in Example 1-1, provided that the alizarin adduct of titanium phthalocyanine was replaced with Mixture 1.

Example 1-3

A photoconductor was obtained in the same manner as in Example 1-1, provided that the alizarin adduct of titanium phthalocyanine was replaced with Mixture 2.

Example 1-4

A photoconductor was obtained in the same manner as in Example 1-1, provided that the alizarin adduct of titanium phthalocyanine was replaced with Mixture 3.

Example 1-5

After charging a ball mill pot with 3 parts of the alizarin adduct of titanium phthalocyanine, 1 part of an azo pigment represented by the following chemical formula (B), 2 parts of polyvinyl butyral BM-S (manufactured by SEKISUI CHEMICAL CO., LTD.), and 495 parts of methyl ethyl ketone, the resulting mixture was ball-milled for 4 hours using PSZ (partially stabilized zirconia) balls each having a diameter of 2 mm, to thereby obtain a charge generation layer coating liquid.

Chemical Formula (B)

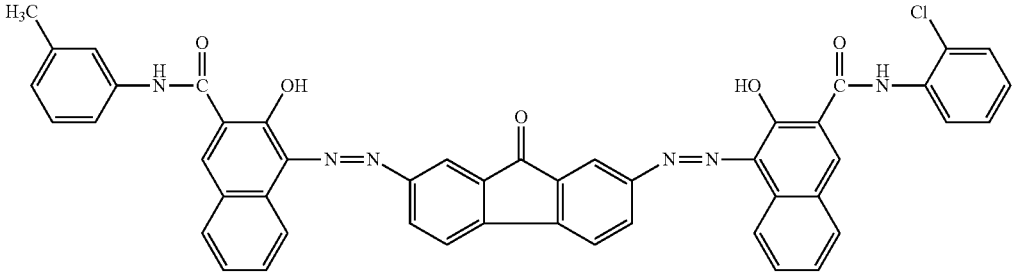

A photoconductor was obtained in the same manner as in Example 1-1, provided that the obtained charge generation layer coating liquid was used.

Example 1-6

After charging a ball mill pot with 3 parts of the alizarin adduct of titanium phthalocyanine, 1 part of the Y-type titanyl phthalocyanine, 2 parts of polyvinyl butyral BM-S (manufactured by SEKISUI CHEMICAL CO., LTD.), and 495 parts of methyl ethyl ketone, the resulting mixture was ball-milled for 4 hours using PSZ (partially stabilized zirconia) balls each having a diameter of 2 mm, to thereby obtain a charge generation layer coating liquid.

A photoconductor was obtained in the same manner as in Example 1-1, provided that the obtained charge generation layer coating liquid was used.

Figure 19:
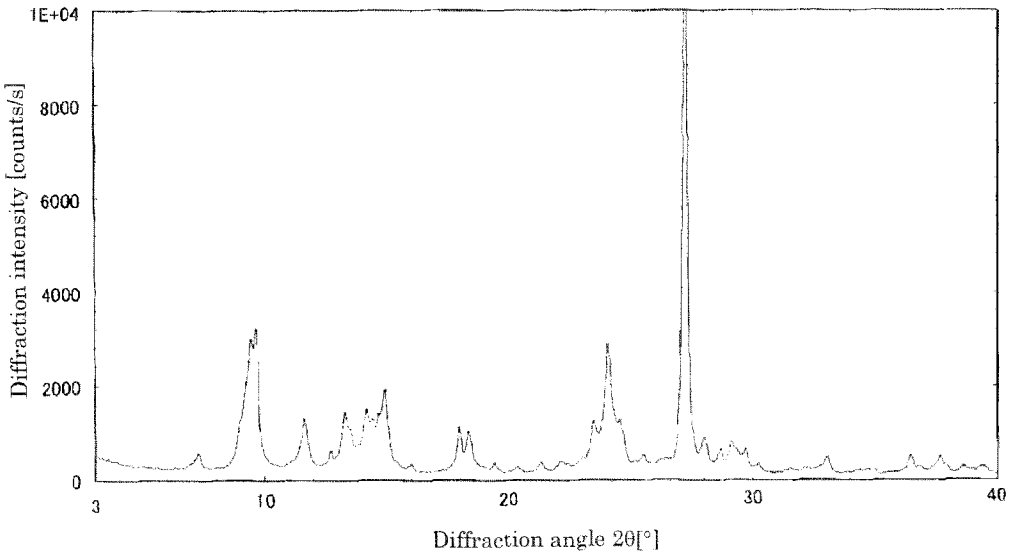
FIG. 19 is an X-ray diffraction spectrum of Y-type titanyl phthalocyanine.

FIG. 19 depicts an X-ray diffraction spectrum of Y-type titanyl phthalocyanine.

Comparative Example 1-1

A photoconductor was obtained in the same manner as in Example 1-1, provided that the alizarin adduct of titanium phthalocyanine was replaced with A-type titanyl phthalocyanine.

Static Properties

Static properties of the photoconductor was measured in a dynamic system (rotational speed: 1,000 rpm) by means of EPA-8100 (manufactured by Kawaguchi Electric Works). First, the photoconductor was charged for 20 seconds with applied voltage of −6 kV, and the electric potential V0 [V] of the surface when the photoconductor was dark decayed for 20 seconds was measured. Thereafter, single color light having a wavelength of 780 nm was applied to the surface of the photoconductor so that the illuminance was to be 1 μW/cm$^2$, and a half-exposure dose $Em_{1/2}$ [μJ/cm$^2$] required for reducing the electric potential of the surface of the photoconductor from −800 V to −400 V was measured as the sensitivity in the near infrared region.

The evaluation results of the electrostatic properties of the photoconductors are presented in Table 1.

TABLE 1

| | $V_0$ [V] | $Em_{1/2}$ [μJ/cm$^2$] |
|---|---|---|
| Ex. 1-1 | −752 | 0.20 |
| Ex. 1-2 | −786 | 0.18 |
| Ex. 1-3 | −761 | 0.15 |
| Ex. 1-4 | −830 | 0.16 |
| Ex. 1-5 | −802 | 0.18 |
| Ex. 1-6 | −748 | 0.11 |

TABLE 1-continued

| | $V_0$ [V] | $Em_{1/2}$ [μJ/cm$^2$] |
|---|---|---|
| Comp. Ex. 1-1 | −847 | 0.37 |

It could be understood from Table 1 that the photoconductors of Examples 1-1 to 1-6 had excellent sensitivity in the near infrared region.

On the other hand, the photoconductor of Comparative Example 1-1 had low sensitivity in the near infrared region, as the A-type titanyl phthalocyanine was used as a charge generation material.

Example 2-1

A charge transport layer coating liquid was obtained by mixing 7 parts of the low molecular hole transport material represented by the chemical formula (A), 10 parts of polycarbonate PCX-5 (manufactured by TEIJIN LIMITED), 83 parts of tetrahydrofuran, and 0.0002 parts of silicone oil KF-50 (manufactured by Shin-Etsu Chemical Co., Ltd.).

After applying the charge transport layer coating liquid onto an aluminum-deposited polyester film through blade coating, the coating liquid was dried for 10 minutes at 120° C., to thereby form a charge transport layer having a thickness of 20 μm.

After pulverizing and mixing 13.5 parts of Mixture 2, 5.4 parts of polyvinyl butyral XYHL (manufactured by Union Carbide Corporation), 680 parts of tetrahydrofuran, and 1,020 parts of ethyl cellosolve, 1,700 parts of ethyl cellosolve was added to the resulting mixture, to thereby obtain a charge generation layer coating liquid.

After applying the charge generation layer coating liquid onto the charge transport layer through spray coating, the coating liquid was dried for 10 minutes at 100° C., to thereby form a charge generation layer having a thickness of 0.2 μm.

A protective layer coating liquid was obtained by mixing 1 part of polyamide CM-8000 (manufactured by Toray Industries, Inc.), 70 parts of methanol, and 30 parts of n-butanol.

After applying the protective layer coating liquid onto the charge generation layer through spray coating, the coating liquid was dried for 30 minutes at 120° C. to form a protective layer having a thickness of 0.5 μm, to thereby obtain a photoconductor.

Example 2-2

After ball-milling 1 part of Mixture 1, and 158 parts of methyl ethyl ketone using alumina balls each having a diameter of 5 mm for 24 hours, 7 parts of the low molecular electron transport material represented by the following chemical formula (C), 5 parts of the low molecular hole transport material represented by the following chemical formula (D), and 18 parts of a polyester adhesive 49000 (manufactured by E.I. du Pont de Nemours and Company) were added to the resulting mixture, to thereby obtain a photoconductive layer coating liquid.

Chemical Formula (C)

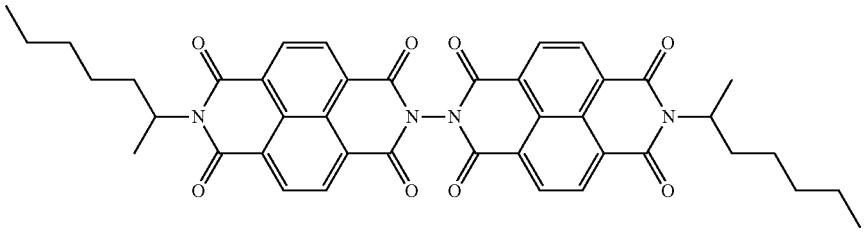

-continued

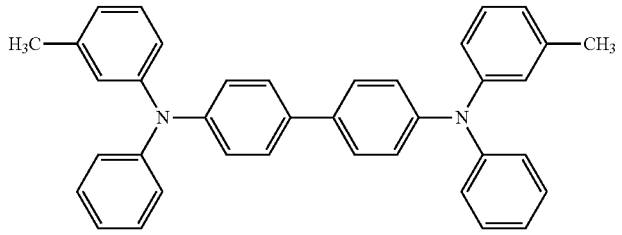

Chemical Formula (D)

After applying the photoconductive layer coating liquid onto an aluminum-deposited polyester film through blade coating, the coating liquid was dried for 30 minutes at 100° C. to form a photoconductive layer having a thickness of 25 μm, to thereby obtain a photoconductor.

Static Properties

Static properties of the photoconductor was measured in a dynamic system (rotational speed: 1,000 rpm) by means of EPA-8100 (manufactured by Kawaguchi Electric Works. First, the photoconductor was charged for 20 seconds with applied voltage of +6 kV, and the electric potential V0 [V] of the surface when the photoconductor was dark decayed for 20 seconds was measured. Thereafter, single color light having a wavelength of 780 nm was applied to the surface of the photoconductor so that the illuminance was to be 1 $\mu W/cm^2$, and a half-exposure dose $Em_{1/2}$ [$\mu J/cm^2$] required for reducing the electric potential of the surface of the photoconductor from 800 V to 400 V was measured as the sensitivity in the near infrared region.

The evaluation results of the electrostatic properties of the photoconductors are presented in Table 2.

TABLE 2

| | $V_0$ [V] | $Em_{1/2}$ [$\mu J/cm^2$] |
|---|---|---|
| Ex. 2-1 | 911 | 0.21 |
| Comp. Ex. 2-1 | 886 | 0.23 |

It could be understood from Table 2 that the photoconductors of Examples 2-1 and 2-2 had excellent sensitivity in the near infrared region.

Example 3-1

An undercoat layer coating liquid was obtained by mixing 400 parts of titanium oxide powder Tipaque CR-EL (manufactured by ISHIHARA SANGYO KAISHA, LTD.), 65 parts of a melamine resin Super Beckamine G821-60 (manufactured by DIC Corporation), 120 parts of an alkyd resin Beckolite M6401-50 (manufactured by DIC Corporation), and 400 parts of 2-butanone.

After applying the undercoat layer coating liquid onto an aluminum cylinder through dip coating, the coating liquid was dried, to thereby form an undercoat layer having a thickness of 3.5 μm.

A charge generation layer coating liquid was obtained by mixing 18 parts of the alizarin adduct of titanium phthalocyanine, 12 parts of polyvinyl butyral BX-1 (manufactured by SEKISUI CHEMICAL CO., LTD.), and 970 parts of 2-butanone.

After applying the charge generation layer coating liquid onto the undercoat layer through dip coating, the coating liquid was dried, to thereby form a charge generation layer having a thickness of 0.2 μm.

A charge transport layer coating liquid was obtained by mixing 10 parts of polycarbonate Z-Polyca (TEIJIN LIMITED), 7 parts of the low molecular hole transport material represented by the chemical formula (A), and 100 parts of tetrahydrofuran, to thereby obtain a charge transport layer coating liquid.

After applying the charge transport layer coating liquid onto the charge generation layer through dip coating, the coating liquid was dried to form a charge transport layer having a thickness of 23 μm on the charge generation layer, to thereby obtain a photoconductor.

Example 3-2

A photoconductor was obtained in the same manner as in Example 3-1, provided that the alizarin adduct of titanium phthalocyanine was replaced with Mixture 1.

Example 3-3

A photoconductor was obtained in the same manner as in Example 3-1, provided that the alizarin adduct of titanium phthalocyanine was replaced with Mixture 2.

Example 3-4

A photoconductor was obtained in the same manner as in Example 3-1, provided that the alizarin adduct of titanium phthalocyanine was replaced with Mixture 3.

Example 3-5

After charging a ball mill pot with 3 part of the alizarin adduct of titanium phthalocyanine, 1 part of the azo pigment represented by the chemical formula (B), 2 parts of polyvinyl butyral BM-S (manufactured by SEKISUI CHEMICAL CO., LTD.), and 495 parts of methyl ethyl ketone, the resulting mixture was ball-milled for 4 hours using PSZ (partially stabilized zirconia) balls each having a diameter of 2 mm, to thereby obtain a charge generation layer coating liquid.

A photoconductor was obtained in the same manner as in Example 3-1, provided that the obtained charge generation layer coating liquid was used.

Example 3-6

After charging a ball mill pot with 3 parts of the alizarin adduct of titanium phthalocyanine, 1 part of the Y-type titanyl phthalocyanine, 2 parts of polyvinyl butyral BM-S (manufactured by SEKISUI CHEMICAL CO., LTD.), and 495 parts of methyl ethyl ketone, the resulting mixture was ball-milled for 4 hours using PSZ (partially stabilized zirconia) balls each having a diameter of 2 mm, to thereby obtain a charge generation layer coating liquid.

A photoconductor was obtained in the same manner as in Example 3-1, provided that the obtained charge generation layer coating liquid was used.

FIG. 19 depicts an X-ray diffraction spectrum of Y-type titanyl phthalocyanine.

Comparative Example 3-1

A photoconductor was obtained in the same manner as in Example 3-1, provided that the alizarin adduct of titanium phthalocyanine was replaced with Mixture 4.

Fatigue Test after Repeated Use

The photoconductor was mounted in a process cartridge. A modified device of imagio MF2200 (manufactured by Ricoh Company Limited), which employed a roller charging system, and had a laser diode (LD) emitted light having a wavelength of 780 nm, was used. After setting the device so that the electric potential after charging was to be −800 V, and the electric potential after exposing was to be −100 V, a fatigue test from repeated use, which was corresponded to continuous printing of 100,000 sheets, was performed. Next, the electric potential after charging and the electric potential after exposing, which were the values after the fatigue test from repeated use had been performed, were evaluated.

The evaluation results of the fatigue test after repeated use are presented in Table 3.

TABLE 3

| | Electric potential after charging [V] | Electric potential after exposing [V] |
|---|---|---|
| Ex. 3-1 | −775 | −95 |
| Ex. 3-2 | −795 | −105 |
| Ex. 3-3 | −805 | −115 |
| Ex. 3-4 | −805 | −110 |
| Ex. 3-5 | −810 | −105 |
| Ex. 3-6 | −790 | −100 |
| Comp. Ex. 3-1 | −565 | −195 |

It could be understood from Table 3 that the photoconductors of Examples 3-1 to 3-6 could prevent reductions in charging ability and sensitivity due to fatigue from repeated use.

On the other hand, the photoconductor of Comparative Example 3-1 caused reductions in charging ability and sensitivity due to fatigue from repeated use, as Mixture 4 of a (R,R)-(−)-2,3-butanediol adduct of titanium phthalocyanine and titanyl phthalocyanine was used as a charge generation material.

This application claims priority to Japanese application No. 2013-190393, filed on Sep. 13, 2013 and incorporated herein by reference.

What is claimed is:

1. A photoconductor, comprising;

an electrically conductive support; and at least a photoconductive layer provided over the electrically conductive support, wherein the photoconductive layer contains a compound represented by the following general formula (1);

General Formula (1)

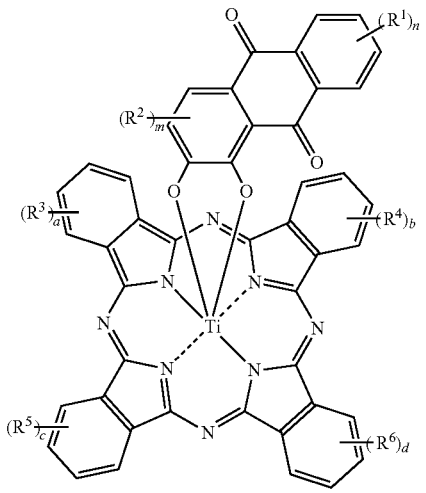

where $R^1$, $R^2$, $R^3$, $R^4$, $R^5$ and $R^6$ are each independently a hydrogen atom, a halogen atom, an alkyl group, an aralkyl group, an alkoxy group, or an aralkyloxy group; n, a, b, c, and d are each independently an integer of 1 to 4 and m is 1 or 2; and a plurality of $R^1$, $R^2$, $R^3$, $R^4$, $R^5$ or $R^6$ may be the same or different when n, m, a, b, c, or d is an integer of 2 or greater.

2. The photoconductor according to claim 1, wherein the photoconductive layer further comprises a compound represented by the following general formula (2):

General Formula (2)

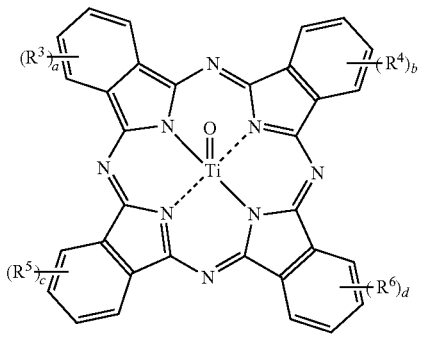

where $R^3$, $R^4$, $R^5$, $R^6$, a, b, c, and d are the same as in the general formula (1).

3. The photoconductor according to claim 2, wherein the photoconductive layer comprises a reaction product between the compound represented by the general formula (2) and a compound represented by the following general formula (3):

General Formula (3)

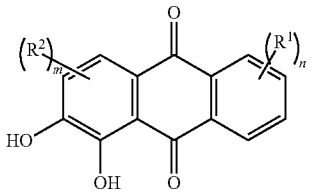

where $R^1$, $R^2$, m, and n are the same as in the general formula (1).

4. The photoconductor according to claim 1, wherein the photoconductive layer further comprises an azo pigment or a phthalocyanine pigment.

5. An image forming apparatus, comprising:

the photoconductor according to claim 1;

a charging unit configured to charge the photoconductor;

an exposing unit configured to expose the charged photoconductor to light to form an electrostatic latent image;

a developing unit configured to develop the electrostatic latent image formed on the photoconductor with a toner to form a toner image; and a transferring unit configured to transfer the toner image formed on the photoconductor to a recording medium.

6. A process cartridge, comprising:

the photoconductor according to claim 1.

7. A compound, which is represented by the following general formula (1):

General Formula (1)

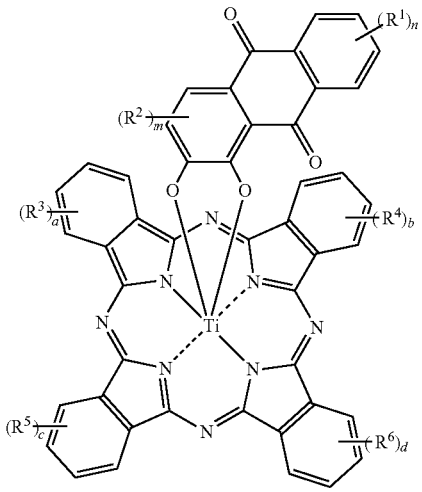

where $R^1$, $R^2$, $R^3$, $R^4$, $R^5$ and $R^6$ are each independently a hydrogen atom, a halogen atom, an alkyl group, an aralkyl group, an alkoxy group, or an aralkyloxy group; n, a, b, c, and d are each independently an integer of 1 to 4 and m is 1 or 2; and a plurality of $R^1$, $R^2$, $R^3$, $R^4$, $R^5$ or $R^6$ may be the same or different when n, m, a, b, c, or d is an integer of 2 or greater.

8. A composition comprising:

the compound according to claim 7; and a compound represented by the following general formula (2):

General Formula (2)

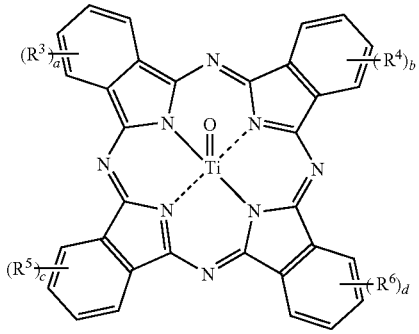

where $R^3$, $R^4$, $R^5$, $R^6$, a, b, c, and d are the same as in the general formula (1).

9. The composition according to claim 8, wherein the composition contains a reaction product between the compound represented by the general formula (2), and a compound represented by the following general formula (3):

General Formula (3)

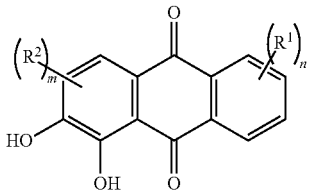

where $R^1$, $R^2$, m, and n are the same as in the general formula (1).

* * * * *